US007980233B2

(12) United States Patent
Wagner et al.

(10) Patent No.: US 7,980,233 B2
(45) Date of Patent: Jul. 19, 2011

(54) CRANKCASE FILTRATION ASSEMBLY WITH ADDITIVE FOR TREATING CONDENSATE MATERIAL

(75) Inventors: Brian Wagner, Stoughton, WI (US); Roger Zoch, McFarland, WI (US); Barry Verdegan, Stoughton, WI (US); Harold R. Martin, Cookeville, TN (US); Jeff Morgan, Stoughton, WI (US); Stephen L. Fallon, Oregon, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 592 days.

(21) Appl. No.: 12/111,445

(22) Filed: Apr. 29, 2008

(65) Prior Publication Data

US 2009/0266346 A1 Oct. 29, 2009

(51) Int. Cl.
*F02B 25/06* (2006.01)

(52) U.S. Cl. ..... 123/572

(58) Field of Classification Search ..... 123/572–574, 123/41.86, 196 R; 55/385.3; 96/53, 33
See application file for complete search history.

(56) References Cited

U.S. PATENT DOCUMENTS

| | | | | |
|---|---|---|---|---|
| 3,241,537 | A * | 3/1966 | Jones | 123/572 |
| 3,499,428 | A * | 3/1970 | Stirling | 123/196 R |
| 3,976,448 | A * | 8/1976 | Eng et al. | 96/53 |
| 5,450,835 | A * | 9/1995 | Wagner | 123/573 |
| 6,161,529 | A | 12/2000 | Burgess | |
| 6,186,128 | B1 * | 2/2001 | Diotte et al. | 123/572 |
| 6,527,821 | B2 * | 3/2003 | Liu et al. | 55/385.3 |
| 6,907,869 | B2 | 6/2005 | Burgess et al. | |
| 7,238,216 | B2 | 7/2007 | Malgorn et al. | |
| 7,250,126 | B2 | 7/2007 | Haberkamp et al. | |
| 2005/0019236 | A1 | 1/2005 | Martin et al. | |
| 2007/0062886 | A1 | 3/2007 | Rego et al. | |
| 2007/0241042 | A1 | 10/2007 | Martin et al. | |

FOREIGN PATENT DOCUMENTS

| | | | |
|---|---|---|---|
| JP | 2006-152890 | A | 6/2006 |
| WO | WO 03/018163 | A1 | 3/2003 |
| WO | WO 2004/045743 | A1 | 6/2004 |

OTHER PUBLICATIONS

Martin et al. "The Development of a Lubrieity Enhancing Controlled Release Diesel Fuel Filter." SAE Paper No. 2003-1-3141, SAE Powertrain & Fluid Systems Conference & Exhibition, Oct. 2003.
Martin et al. "The Development of an Optimized Slow Release Lubrieity Enhancing Fuel Filter." SAE Paper No. 2006-1-3362, SAE Powertrain & Fluid Systems Conference and Exhibition, Oct. 2006.
International Search Report of PCT/US2009/041681, dated Dec. 14, 2009.
Written Opinion of the International Searching Authority of PCT/US2009/041681, dated Dec. 14, 2009.

* cited by examiner

*Primary Examiner* — M. McMahon
(74) *Attorney, Agent, or Firm* — Hamre, Schumann, Mueller & Larson, P.C.; J. Bruce Schelkopf

(57) ABSTRACT

A separation assembly is generally described that can chemically treat condensate material in a fluid stream. One particular example of a separation assembly is a crankcase filtration assembly used in engine oil filtration and that includes an additive material disposed within the crankcase filtration assembly. The additive material chemically treats condensate material of blow-by fluids received by the crankcase filtration assembly when a condition is present in the condensate material. For example, the crankcase filtration assembly provides a unique structure with a chemically treated component that can reduce an acidic condition in condensate material received by the crankcase filtration assembly, and even more generally may extend engine oil life.

19 Claims, 10 Drawing Sheets

CRANKCASE FILTRATION ASSEMBLY WITH ADDITIVE FOR TREATING CONDENSATE MATERIAL

FIELD

A separator assembly is disclosed that can generally improve a fluid's operating life. In particular, a crankcase filtration assembly is described that is generally useful in engine oil filtration applications. The crankcase filtration assembly includes an additive material that can chemically treat condensate material separated from blow-by fluids that have entered the crankcase filtration assembly during engine crankcase ventilation.

BACKGROUND

Separation and filtration products, for instance crankcase filtration assemblies are widely known and used in a number of practical engine applications, particularly with respect to engine oil filtration. For example, during the combustion process in a spark ignited or compression ignition engine, compression gases and other byproducts of combustion may enter into an engine's crankcase. This condition is called blow-by. At this time, gas pressure develops in the crankcase that is above atmospheric pressure. Due to the pressure increase, the gases are ventilated from the engine crankcase through openings, which are usually located in a valve cover assembly or upper engine block area. During this process, the gases in the crankcase typically come into contact with the oil splash lubrication of the crankshaft, as well as other oil saturated components and condensates. These gases become entrained with oil mist while being ventilated from the engine. The oil mist also contains droplets formed by cooling and condensation of hydrocarbons in the gases of the blow-by fluids. The blow-by fluids which contain the gases and condensates are ventilated by the engine crankcase.

When the crankcase ventilates into the surrounding environment it is known as open crankcase ventilation (OCV). In some applications, the gases are returned to the engine through an air intake system and then burned. This is called closed crankcase ventilation (CCV). In CCV, however, there is potential for oil residue to contaminate the turbocharger/air intake system causing necessary repairs, as the oil mist contains oil droplets, including a large fraction that are submicron in size or invisible to the naked eye. Such "invisible" droplets for example may be approximately 40 μm or less. Over time, the blow-by flow rate increases. This results in blow-by gases that may be carrying an increased amount of oil mist and other condensate material.

Effective crankcase ventilation filtration helps to maintain a clean engine compartment, protects the environment, and for CCV protects the engine itself. Crankcase ventilation filtration aims to reduce or eliminate the oil droplets, mist, and condensate from the ventilated gases. Crankcase filtration assemblies are often used to remove the oil drops and oil mist (aerosol) from the ventilated gases and air before they enter the surrounding environment (OCV) or before they return to the engine (CCV).

In general, crankcase ventilation filtration typically occurs through a process known as separation, for example through a coalescer element and/or impactor element. Generally, oil droplets and/or mist and water droplets and/or mist, and other condensates are separated from the blow-by gases. When a coalescer element is employed, the smaller particles coalesce into larger drops until they are large enough to be effected by gravity and drain back into the engine crankcase. To aid in the coalescing process, crankcase filtration assemblies often employ a media structure that temporarily collects the small droplets, so that they may form into larger drops that eventually drain from the crankcase filtration assembly. In the example of an impactor element, a structure is employed that gets in the way of, or impacts the contaminated air flow to trap the oil mist. While such structures are helpful to engine oil filtration, oil droplets/mist/other condensate material flowing through the crankcase filtration assembly may, in some situations, exhibit characteristics detrimental to the operating life of the engine oil, such as elevated oil acidity or high viscosity. Improvements can still be made to crankcase filtration assemblies and their structure.

SUMMARY

The following technical disclosure describes a unique separator assembly that can chemically treat condensate material. In one particular example, a crankcase filtration assembly is described which can chemically treat condensate material separated from blow-by fluids that have been released from an engine crankcase and that enter the crankcase filtration assembly. The crankcase filtration assembly described generally includes an additive material disposed within the crankcase filtration assembly in various configurations and on various structures, where the additive material chemically treats the separated condensate material when a condition is present in the condensate material.

In one embodiment, a crankcase filtration assembly for oil filtration of an engine includes a housing having an inlet configured to receive blow-by fluids ventilated by the engine. A separator is disposed within the housing. The separator is configured to separate condensate material from gases of the blow-by fluids. The housing includes an outlet configured to release the gases of the blow-by fluids from the housing, and includes a drain configured to release the condensate material from the housing. An additive material is disposed on a structure within the crankcase filtration assembly. The additive material is configured to chemically treat the separated condensate material when a condition is present in the condensate material.

In some embodiments, the additive material is disposed on at least one of an inner surface of the housing, a surface of the separator, and an inner surface of a drain hose connected to the drain of the housing.

In one embodiment, the additive material includes a chemical material that chemically treats the separated condensate material and is suitable for use in the engine. In yet another embodiment, the additive material is an alkaline chemical additive.

In some embodiments, the additive material is configured to remove condensate material that is detrimental to a fluid's operating life and retain such condensate material within the crankcase filtration assembly. In other embodiments, the additive material is configured to be released into the separated condensate material when a releasing condition is present in the condensate material. In other embodiments, the additive material may be a plurality of additive chemicals that may perform both functions.

In yet another embodiment, the crankcase filtration assembly includes a release mechanism configured to release the additive material when the releasing condition is present. In one embodiment, the release mechanism is configured to release the additive material over a period of time.

In one embodiment, the releasing condition includes at least one of contact between the additive material and the condensate material, contact between the additive material and condensate material having an acidic condition as evidenced by the existence for example of a higher total acid number (TAN) in the condensate material relative to new lubricating oil (i.e. pH below 7), deterioration of the oil's additive package, increased levels of undesirable chemical species (e.g., water, byproduct of oil oxidation or thermal decomposition, sludge,) in the condensate, and more generally a condition present in the condensate material which reduces engine oil life.

In one embodiment, a method of engine oil filtration includes receiving blow-by fluids ventilated by an engine into a crankcase filtration assembly. Generally, condensate material of the blow-by fluids is then separated from the other gases of the blow-by fluids. The condensate material is treated with at least one additive material when a condition is present in the condensate material. The gases of the blow-by fluids are released from the crankcase filtration assembly, and the separated condensate material is released from the crankcase filtration assembly separately from the blow-by gases.

DETAILED DESCRIPTION

Figure 1:
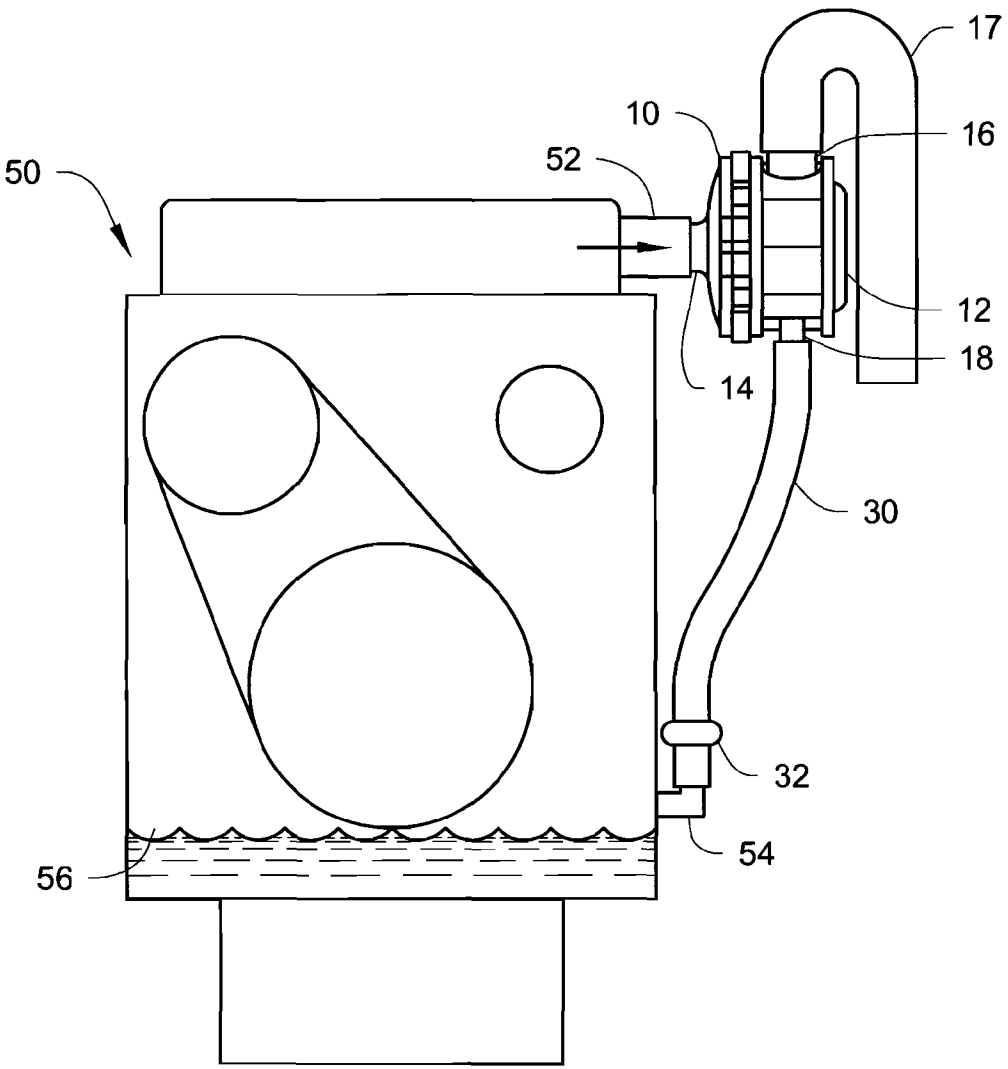
FIG. 1 is an embodiment of a crankcase filtration assembly shown with an engine.

The following description is generally for an improved separator assembly. One particular implementation of the inventive structures and methods for the separator assembly described herein is in crankcase filtration assemblies. Generally, an additive material is disposed within the crankcase filtration assembly in various configurations and on various structures. The additive material is configured to chemically treat condensate material separated from blow-by fluids that are received by and flow through the crankcase filtration assembly. The additive material chemically treats the condensate material when a certain condition(s) is present in the condensate material.

Typically in engine combustion, blow-by gases get by piston rings and enter the engine crankcase. This condition is often called blow-by. The term "blow-by fluids" is meant as crankcase blow-by including combustion gases and air which also has come into direct contact with the oil splash lubrication of the crankshaft, as well as other oil saturated components and condensates. The crankcase blow-by gases may then become entrained with particulates including oil droplets, soot, and other condensates, and often carry oil mist while being ventilated from the engine crankcase. The blow-by fluids (including combustion gases and air as well as condensate materials including water drops and/or mist, oil drops and/or mist, and other non-gaseous material) can have actual droplets of oil and/or water which are visible, and can include aerosol contaminants or other condensate material that are sub-micron or invisible to the naked eye, for example 40 μm or less.

As above, one exemplary implementation for the improved separator assembly is in crankcase filtration assemblies, which are generally used in engine oil filtration. In particular, the crankcase filtration assembly described herein provides a unique structure having a component chemically treated with an additive material, which may allow for reducing an elevated acidic condition present in the condensate material of the blow-by fluids received by the crankcase filtration assembly. More generally, the component chemically treated with additive material may extend engine oil life. The crankcase filtration assembly described herein may be employed in any type of crankcase filtration system for engine oil filtration, including use for example in natural gas engines and diesel engines, and industrial engines including stationary or vehicular engines.

While the inventive concepts described herein are particularly well suited for engine crankcase ventilation applications, the inventive concepts have more general uses in other separation systems having immiscible fluids, e.g. air-oil, air-water, etc. More generally, the inventive concepts described herein are useful for separation systems that generally have a need to collect a condensate, chemically treat it, and return it to its source in a regenerated and/or improved form. For example, such separation systems may include but are not limited to boiler steam applications, food preparation applications, and hydraulic systems applications.

FIGS. 1-5 illustrate one embodiment of a crankcase filtration assembly 10. FIG. 1 shows the crankcase filtration assembly 10 incorporated with an engine 50. The crankcase filtration assembly includes a housing 12. The housing 12 includes an inlet 14. The inlet 14 is configured to be connected to an outlet 52 of the engine 50 and to receive crankcase blow-by fluids exiting the outlet 52. The housing 12 includes an outlet 16. The outlet 16 is configured to release gases of the blow-by fluids from the crankcase filtration assembly 10, while condensate material of the blow-by fluids is separated. The outlet 16 may include a vent hose 17 connected to the outlet 16. The vent hose 17 may release the gases to the surrounding environment (i.e. in open crankcase ventilation) or may be employed as a further connection of the engine, for example to an air intake or turbocharger system of the engine (i.e. in closed crankcase ventilation systems). The structure and operation of separating the condensate material from the gases of the blow-by fluids is further discussed below.

The housing 12 also includes a drain 18. The drain 18, after the condensate material have been separated from the gases, is configured to release the condensate material (i.e. liquid oil and water drops and/or mist, other condensate and/or non-gaseous material) from the crankcase filtration assembly 10. As shown in FIG. 1, the drain 18 in some embodiments may include a drain hose 30 connected to the drain 18, where the drain hose 30 is connected to an inlet 54 of the engine 50. The condensate material may enter a reservoir 56 and be returned to and reused in the engine.

In one embodiment, a check valve 32 may be connected to the drain hose 30. For example, condensate material collects in the drain hose 30 and is held in the drain hose 30 by the check valve 32. When the pressure of the condensate material exceeds the pressure of the crankcase, the check valve 32 opens and the condensate material may drain to the crankcase. As another example, at shutdown where there is no engine pressure, the condensate material in the drain hose may empty to the engine crankcase. Such check valves are well known in the art and are not further described.

Figure 2:
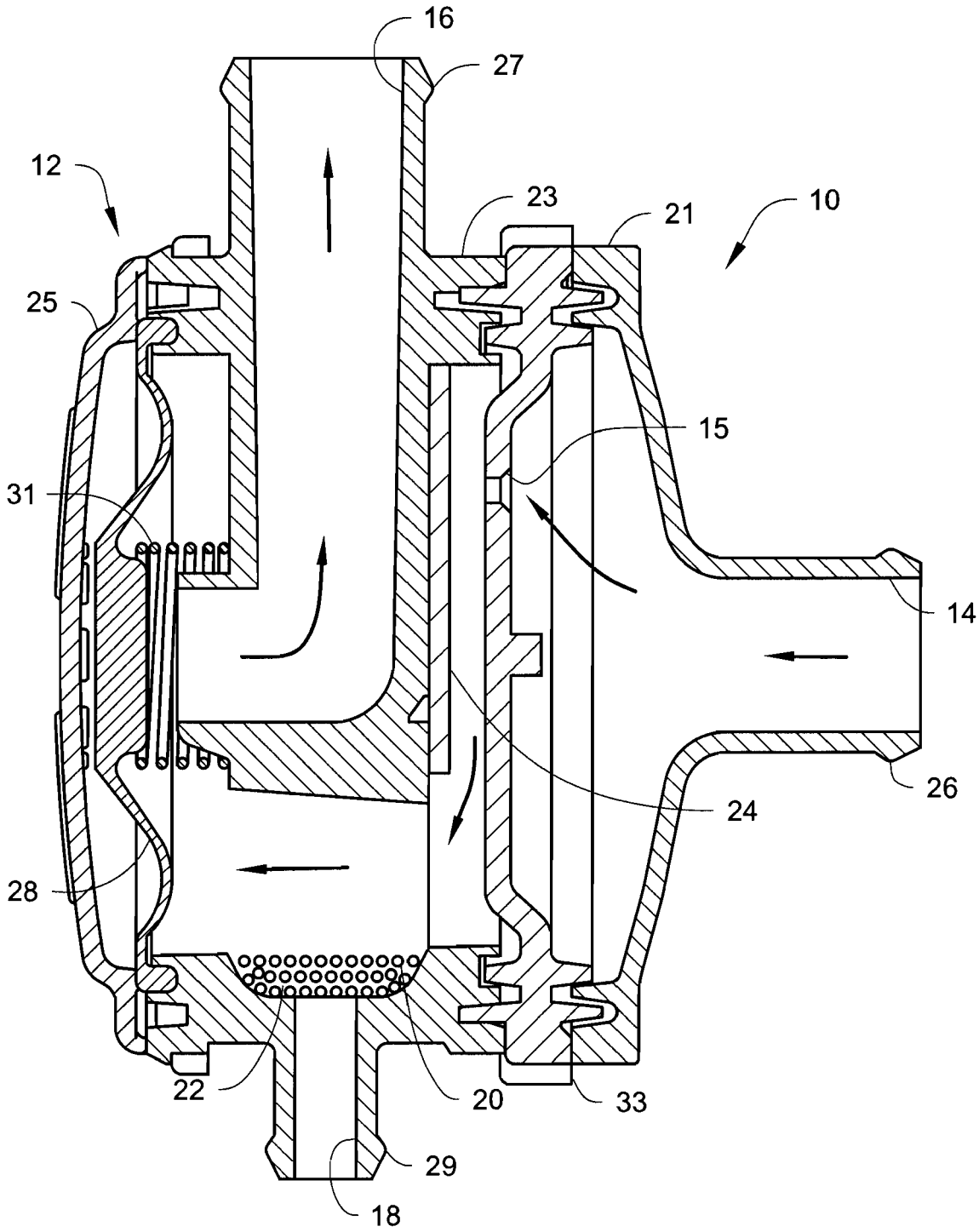
FIG. 2 shows a side sectional view of the crankcase filtration assembly of FIG. 1 and shows one embodiment of an additive material disposed on an inner surface of a housing within the crankcase filtration assembly.

Turning to FIG. 2, a side sectional view of the crankcase filtration assembly 10 is shown. The housing 12 may include multiple components arranged together to form its various inner surfaces. For example, a component 21 including the inlet 14 may be constructed as one end or side component of the housing 12, and includes a fitting 26 for connecting the inlet 14 to the outlet of an engine (i.e. outlet 52 of engine 50). As one embodiment, the fitting 26 may be a barbed connection, but it will be appreciated that other fittings may be used as suitable or as may be known in the art. A nozzle 15 is formed through component 21 to provide access of the blow-by fluids to the crankcase filtration assembly 10. One nozzle 15 is shown in FIG. 2, however, it will be appreciated that more than one nozzle may be employed.

The component 21 including the inlet 14 is connected to a component 23 through a seal plate 33. As shown, the component 21, component 23, and seal plate 33 are connected by a tongue and groove structure. One of skill in the art will appreciate the connection structure as shown is merely exemplary and other connection structures may be employed as may be suitable and as may be known in the art. The component 23 includes the outlet 16 and drain 18. The outlet 16 and drain 18 respectively include suitable fittings 27, 29, so that a vent hose (i.e. vent hose 17) and a drain hose (i.e. 30) may respectively be connected to the outlet 16 and drain 18. As one example, the fittings 27, 29 are barbed connections, but one of skill in the art will recognize that various fitting structures can be employed as suitable or may be known in the art.

Another end or side component 25 is connected to the component 23, which thereby forms the housing 12 with the component 21. In one embodiment, a pressure control diaphragm 28 is mounted with a biasing member 31, such as a spring, between and against the component 25 and the component 23. The pressure control diaphragm 28 may be used for crankcase filtration assemblies employed in closed crankcase filtration, so as to help maintain an operative crankcase pressure.

As shown, the housing components may be connected in a fluid tight seal, such as through the tongue and groove structure between components 21, 23, and 25, and seal plate 33. Various gasket seals between the components may be employed as desired and/or necessary. One of skill in the art also will appreciate that various configurations may be employed for forming the housing 12 and for sealing any components used to construct the housing 12, and one of skill in the art will appreciate that the specific component and attachment configuration shown is not meant to be limiting.

Turning to the separation structure, FIG. 2 shows a separator 24 disposed on the housing 12 and is configured to separate the condensate material from the blow-fluids entering the crankcase filtration assembly 10. The separator 24 allows the gases of the blow-by fluids to be released by removing the condensate material from the blow-by fluids, including for example oil and/or water droplets, oil and/or water mist, and other non-gaseous material or condensates.

The term "gases" of the blow-by fluids is meant to include any material that may not have been removed by the separator 24, for example air and exhaust gases, which may include some aerosol particles not removed by the separator 24. Generally, the term gases is meant as material/fluid carried over or through the separator.

In one embodiment, the separator 24 is an impactor element disposed proximate the inlet 14 and proximate the nozzle 15. As the blow-by fluids enter the inlet 14 and pass through nozzle 15, the speed of the blow-by fluids becomes accelerated. The impactor element provides an impact surface for the blow-by fluids that enter the crankcase filtration assembly 10, and provides a surface for causing a change in their flow direction. As a result of such a change in flow direction of the blow-by fluids, the impactor element and nozzle structure causes the condensate material to fall out of the blow-by fluids.

Various condensate matter may be separated by an impactor element and can include larger and heavier condensates (about or more than 10 μm). Depending on the media employed for the impactor element, smaller sized condensates may also be separated including condensate material that may be about or even less than 1 μm.

Figure 4:
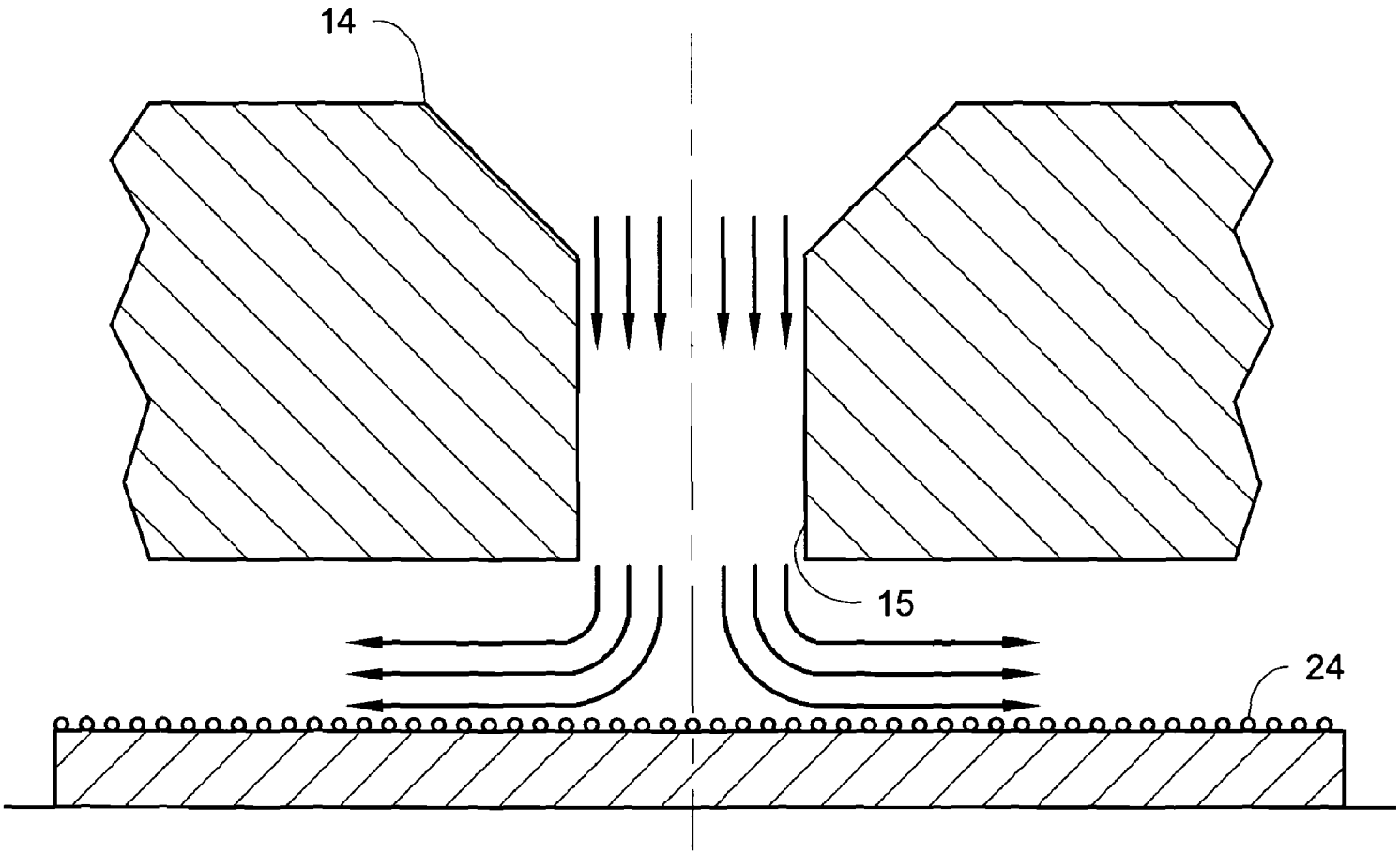
FIG. 4 is a magnified sectional view of the additive material disposed on the separator, where the separator is an example of an impactor element.

FIG. 4 is a magnified view of the separator 24 and nozzle 15 configuration, which shows the rapid change of direction (see arrows) once the blow-by fluids enter the inlet 14 through nozzle 15. As one example, the separator 24 is generally a planar-shaped surface suitable for impacting the incoming blow-by fluids. Generally, a suitable structure for an impactor element is one that can "get in the way of" or impact the flow of the blow-by fluids as they enter the crankcase filtration assembly, so that condensate material present in a liquid gas stream may be removed. It will be appreciated that the impactor element may be constructed of any separation media as may be known in the art. Other examples of an impactor element and their construction, which are well known, can be found in U.S. Pat. No. 7,238,216 which describes an inertial gas-liquid impactor for removing particles from a liquid gas stream, and which is herewith incorporated by reference in its entirety. One of skill in the art will appreciate that the separator is not limited to the particular structure or configuration shown in FIGS. 2 and 4, and will appreciate that various constructions and configurations for an impactor element may be employed for accomplishing the separator function.

In another embodiment, the separator is a coalescer element. In such an embodiment, the coalescer element typically includes a certain filter media construction. The filter media may be configured such that, when the blow-by fluids enter crankcase filtration assembly, the condensate material coalesces so as to be separated from the gases of the blow-by fluids. In one embodiment, the filter media is constructed to produce optimum results for coalescing the condensate material. As one example only, the media may be constructed of a gradient fiber structure that includes multiple fibers such as may be known in the art. The gradient fiber structure may be configured as multiple layers, where the fineness of the fibers increases from the side of the coalescer element proximate the inlet 14 toward the side distal from the inlet 14. It will be appreciated, however, that the coalescer element may be constructed of any separation media as may be known in the art.

Other examples of coalescer elements can be found in U.S. Patent Application Publication No. US 2007-0062886 A1, which describes filter media coalescers and which is herewith incorporated by reference in its entirety. It will be appreciated that coalescers are well known in the art for coalescing and separating a medium having two immiscible phases, namely a continuous phase and a dispersed phase. For example: in engine crankcase ventilation systems, and other air-oil separation systems, the continuous phase is air or gas, and the dispersed phase is oil; in air-water separation systems, air or gas is the continuous phase, and water is the dispersed phase.

It will be appreciated that the coalescer element may be arranged and configured using other implementations as may be known in the art, as long as coalescing of the condensate material can be accomplished. Such other implementations may include, but are not limited to, wire mesh, screens, filters, or any other suitable coalescing structures. Generally, a suitable coalescing structure also can momentarily trap and collect smaller droplets and condensates (i.e. less than 40 μm), so that larger drops may form (coalesce) and then fall out of the coalescer element.

The crankcase filtration assembly 10 further includes an additive material 20. Generally, FIG. 2 shows one embodiment of the crankcase filtration assembly 10 having the additive material 20 disposed on an inner surface 22 of the housing 12. The inner surface 22 is disposed proximate the drain 18. After larger condensates such as oil droplets have been removed from the blow-by fluids they drip or fall toward the drain 18 at the inner surface. When the smaller condensates such as oil mist and other condensates have separated (i.e. by an impactor and/or coalescer) and have been removed from the gases of the blow-by fluids, they drip or fall toward the drain 18 at the inner surface 22. In one embodiment, the inner surface 22 is configured as a sump or collection reservoir, where the additive material 20 is disposed thereon. One of skill in the art will appreciate that the inner surface 22, where the additive material 20 is disposed, is not limited to the specific configuration shown. The additive material 20 may be disposed on various other inner surfaces inside the housing 12, as long as the condensate material may come into contact with the additive material 20. Likewise, one of skill in the art will further appreciate that the inner surface may not be a dedicated sump or collection reservoir or even proximate the drain 18.

The term "additive material" is generally meant as a chemical material that can chemically treat the condensate material flowing through the crankcase filtration assembly 10 and also may chemically treat the oil in the engine. Such chemical treatment generally may include providing an enhancing property of the engine oil, extending the operating life of the engine oil, and/or preventing conditions which may reduce the operating life of the engine oil. One of skill in the art will appreciate that the additive material is a chemical that is suitable for use in an engine system.

In certain embodiments, the additive material is configured to be released into the separated condensate material when a releasing condition is present in the condensate material. In other embodiments, the additive material is configured to remove a portion of the condensate material that is detrimental to a fluid's operating life and retain such condensate material within the crankcase filtration assembly. In such a configuration, the additive material may be disposed within the crankcase filtration assembly to be able to readily contact condensate material flowing through, but also is fixed inside the crankcase filtration assembly. The term "fixed" is meant where the additive material is retained or otherwise secured within the crankcase filtration assembly. In other embodiments, the additive material may be a plurality of additive chemicals that may perform both functions.

As one example of a releasable additive, the additive material is a chemical material, such as an alkaline chemical (greater than pH 7). Using an alkaline chemical as the additive material is useful when the condensate material increased acidic condition. For example, an increased acidic condition is represented by total acid number (TAN), where the condensate material has a higher total acid number (TAN) relative to new lubricating oil. The alkaline chemical helps to neutralize an acidic condition that may exist in the condensate material flowing through the crankcase filtration assembly, and including the oil of the engine. Once the alkaline chemical is released, it may contact and react with the condensate material to neutralize the acidic condition.

Some exemplary alkaline chemicals (or base) that may be used in the additive material may include, but are not limited to the following descriptions and preparations. For example, the base is an alkaline earth metal composition selected from the group consisting of metal oxides, metal hydroxides, metal carbonates, metal bicarbonates, Lewis bases, sacrificial metals, and mixtures thereof. The metal oxides are selected from the group consisting of MgO, CaO, MnO, $MnO_2$, ZnO, BaO, $TiO_2$, and the hydroxides and carbonates are selected from the group consisting of $Mg(OH)_2$, $MgCO_3$, $Ca(OH)_2$, $CaCO_3$, $NaAlO_2$, $Na_2CO_3$, NaOH, $Al(OH)_3$, $NaHCO_3$.

As noted, the base can be a sacrificial metal, e.g. zinc (Zn), magnesium (Mg), providing a sacrificial anodic reaction, where the sacrificial material can dissolve, dissipate, or otherwise disseminate over time into the condensate material. When using sacrificial metals, care should be taken in order to minimize catalytic oxidation of the oil by the metal.

In other examples, VI improvers may be employed as the additive material or a part thereof. VI improvers are known to modify the viscometric characteristics of lubricants by reducing the rate of thinning with increasing temperature and the rate of thickening with low temperatures. VI improvers thereby provide enhanced performance at low and high temperatures.

In yet other examples, the additive material may be any one or more of various dispersants and/or detergents to prevent lube system and turbo deposits and to keep soot dispersed. Other examples for the additive material may include wear inhibitors, such as ZDDP for high wear applications, or an overbase for applications that generate a lot of acidic byproducts. Other additive materials that may be considered may include any one or more combustion/emission improvers, such as cetane improvers and/or fuel borne catalysts. Such additives as well as other lube additives may be helpful, where the additive material also is released to the crankcase As yet another example, the additive material may include a solution of triethanolamine, NaOH, and isopropyl alcohol, which is dried to render the composition alkaline.

Further details on such additive materials including the active material(s) which may have an effect on the condensate material, and including any binders, adhesives and/or other materials which may be employed in the preparation and formulation thereof are described for example in U.S. Pat. No. 7,250,126, which is herewith incorporated by reference in its entirety. Some examples of relative amounts used in the preparatory materials, and some examples of resulting particle sizes of certain formulations also are described, for instance in U.S. Pat. No. 7,250,126. It will be appreciated that a fully formulated additive material composition, whether a single chemical or combinations of chemicals, may be employed depending on the application and performance goals.

In yet other examples, the additive material may include any one or more of the following chemicals and functionalities listed in Table 1, which also is referenced in PCT International Publication No. WO 03/018163 A1, US Patent Application Publication Nos. US 2007/0241042 A1 and US 2005-0019236 A1 and which the applications are herewith incorporated by reference in their entirety.

TABLE 1

| Additive Type | Classes of Additives | Function | Examples of Additives |
|---|---|---|---|
| Detergents | Metallic Dispersants, Overbase Additives | Disperse particulate matter in fluid, for example, oil | Sodium, barium, calcium or magnesium salts of salicylate esters, sulfonates, phosphonates, phenates, thiophosphonates, sulfophenates, alkoxides, or carboxylates |
| Dispersants | Ashless Dispersants | Inhibit formation of sludge and varnish to reduce deposit | Long-chain and/or high molecular-weight ashless organic molecules, such as N-formation substituted alkenyl succinimides, esters and polyesters amine and polyamine salts of organic acids, Mannich bases derived from alkylated phenols, copolymers of methacrylates or acrylates containing polar groups,* ethylene-propylene copolymers containing polar groups,* or vinyl acetate-fumaric acid ester copolymers |
| Antioxidants | Oxidation Inhibitors | Prevent deterioration and oxidation of fluid, for example oil | Zinc dialkyl or diaryl dithiophosphates; phenolic compounds, organic phosphites; metal dithiocarbamates; sulfurized olefins; hindered or aromatic amines; organo selenides; phosphorized or sulfurized terpenes |
| Corrosion Inhibitors | Rust Inhibitors, Bearing Corrosion Inhibitors, Antirust Agents, Overbase Additives, Metal Passivators | Inhibit corrosion and/or rust formation | Zinc dithiophosphates; organic phosphites; metal dithiocarbamates; phosphorized or sulfurized terpenes; sulfurized olefins; aromatic nitrogen compounds; sulfonates; alkenyl succinic acids and derivatives; propoxylated or ethoxylated alkyl phenols; substituted imidazolines; barium, calcium or magnesium salts of oxides or carbonates |
| Antiwear Additives | Extreme Pressure Additives, Friction Modifiers Antiwear Agents, Extreme Pressure Agents, Oiliness Agents | Reduce wear | Zinc, calcium, magnesium, nickel, cadmium or tetralkyl ammonium salts of dithiophosphoric acid; various molybdenum sulfur compounds; organic phosphites; sulfurized olefins; various triazoles; fatty acid derivatives; dicarbamate derivatives; alkaline compounds as acid neutralizers |
| Viscosity Index Improvers | Viscosity Modifiers, Viscosity Improvers | Lower the rate of change in viscosity with temperature | High molecular-weight polymers, such as olefin copolymers (e.g., ethylene-propylene copolymers, polyisobutenes); various styrene copolymers (e.g., butadiene, isoprene, ester); or esters (e.g., acid ester copolymers, polymethacrylates) |
| Pour Point Depressants | Wax Modifiers, Cold Flow Improvers | Lower the temperature at which the fluid flows and improve filterability | Alkylated naphthalene; polymethacrylates; crosslinked alkylated phenols; vinyl acetate-fumaric acid ester copolymers; alkyl fumarate; vinyl ester copolymers; |

TABLE 1-continued

| Additive Type | Classes of Additives | Function | Examples of Additives |
|---|---|---|---|
| | | | styrene-ester copolymers; derivatized alkyl methacrylate-acrylate copolymers; olefin copolymers; alkylated polystyrene |
| Antifoamants | Anti-foam Agents | Prevent formation of stable foam in fluids | Silicones, polyethers |
| Demulsifiers | | Promote oil-water separation | |
| Emulsifiers | | Promote formation of stable water-in-oil emulsion by reducing size of dispersed water droplets | Metal salts of carboxylic acids |

*polar groups include such groups as amines, amides, imines, imides, hydroxyl, ether, etc.

References: P. A. Asseff, "Lubrication Theory and Practice," The Lubrizol Corporation, document 183-320-59 N. Benfaremo and C. S. Liu, "Crankcase Engine Oil Additives," Lubrication 76(1): 1-12, publ. Texaco Inc. 1990. J. Chu and R. K. Tessmann, "Additives Packages for Hydraulic Fluids," The BFPR Journal 12(2): 111-117, 1979

As discussed, some embodiments may employ an additive material including a chemical that is configured to remove a portion of the condensate material and retain such condensate material within the crankcase filtration assembly. As one example of such an additive material, a desiccant and/or water absorbent chemical may be included in the additive material. A desiccant can bind and hold water in the crankcase filtration assembly. In such a configuration, the condensate material would be removed from the engine oil and be retained in the crankcase filtration assembly, so that it does not get re-introduced to the engine oil.

In some instances, a superabsorbent polymer is employed. Superabsorbent polymers absorb from about 25 to greater than 100 times its weight in water and may comprise a polymer of acrylic acid, and acrylic ester, acrylonitrile or acrylamide, including co-polymers thereof or starch graft copolymers thereof or mixtures thereof.

Other materials for the removal of water in oil can include water-absorbent polymers produced by the polymerization of a monomer containing a water-soluble nonionically unsaturated monomer.

Desiccants such as anhydrous, or preferably slightly moisturized, sodium tripolyphosphate or sodium carbonate may also be employed. Other examples of desiccant compounds include inorganic or organic molecules. Examples of inorganic desiccant compounds are: $CaCl_2$, $MgCl_2$, LiBr, LiCl, $K_2CO_3$, $Pb(NO_3)_2$, KF, $NaSO_4$, $K_3PO_4$, $CrO_3$, $NaNO_2$, $Mg(NO_3)_2$, KSCN, $KC_2H_3O_2$, $Zn(NO_3)_2$, $ZnBr_2$, $K_2HPO_4$, $NaClO_3$, silica gel, silicates, aluminas, zeolites, carbon, molecular sieves. Some preferred inorganic desiccants may be $K_3PO_4$, $K_2CO_3$, and $CaCl_2$. Examples of organic desiccant compounds are polyalcohols, polyethers, polysaccharides, polyacrylamides, polyacrylates and combinations or mixtures thereof. Some preferred organic desiccants are polyethylene glycol 300, polypropylene glycol 700, block copolymers of polyethylene glycol and polypropylene glycol, and glycerol. Other suitable compounds known as advanced desiccant materials may also be employed. Such compounds may include but are not limited to 2-acrylomido-2-methyl-1 propane-sulphonic acid (AMPSA) and polystyrene sulfonic acid (PSSA) and their salts with sodium, lithium, potassium and cesium.

The additive material may also utilize such ingredients as solid sorbents. With the term "solid sorbents", it is herein meant as any solid material, in whatever physical form, that has characteristics of adsorbing inorganic or organic molecules. These solid sorbents can be introduced inside a filtration assembly as a deposit, as a filter media, or disposed on a filter media and/or embedded therein. Such solid sorbents may also be implemented in the filtration assembly such as on a solid part of the assembly itself, including on the packing material, a wall, or a casing.

Examples of solid sorbents that may be possibly used include: activated carbon (in granular, amorphous, fiber, extrudate, or powder form), impregnated or coated or chemically modified activated carbon, silica, chemically modified silica, zeolites, chemically modified zeolites, aluminas, and chemically modified aluminas.

Turning back to FIG. 2, as the droplets, mist, and condensates are removed from the blow-by fluids, the gases of the blow-by fluids may continue on and are ventilated from the crankcase filtration assembly 10 through the outlet 16 (see arrows in component 23).

Regarding the example where the additive material 20 is releasable, the crankcase filtration assembly 10 may further include a release mechanism for releasing the additive material 20, so that it can react with the condensate material. The release mechanism may be configured and arranged in a number of ways. The release mechanism is configured to release the additive material 20 when a releasing condition is present. In some examples, the releasing condition is the presence of the condensate material alone, and/or is at least one certain condition exhibited by the condensate material. Such conditions that may be exhibited by the condensate material may include, but are not limited to, an acidic and a high viscosity condition. One of skill in the art will appreciate that the releasing condition(s) may include any condition which reduces, or is otherwise detrimental to the operation life of the engine oil. Likewise, one of skill in the art will recognize that a releasing condition would be that condition(s) for which an additive material is employed to have a particular desired effect.

One embodiment of the release mechanism shows the additive material 20 contained in a plurality of capsules. FIG. 2 shows the capsules disposed on the inner surface 22 (i.e. sump or collection reservoir). In this embodiment, the capsule structure is the release mechanism for releasing the additive material 20 into the condensate material (i.e. oil and/or water droplets, mist, and/or other non-gaseous material) that collect in the sump. For example, the capsules provide a casing structure for holding the additive material 20, and for releasing the additive material 20 when the condensate material permeates through the capsule casing, or otherwise dissolves the capsule casing. It will be appreciated that the additive material 20 may be simply free-floating and contained within the sump and not necessarily disposed on the surface of the sump. In such an example a screen or mesh may be employed between the sump and the drain to prevent the capsules from prematurely draining from the assembly 10.

The capsule casing is configured of a material that may be dissolvable, such as by a particular releasing condition present in the condensate material. In one embodiment, the capsules include a soluble polymer seal or skin formulated to dissolve only when the releasing condition is present. In such a configuration, the release mechanism releases or introduces the additive material when the additive material is actually needed. Further in such a configuration, the additive may be released over a period of time, where the release mechanism may last several filter intervals. One of skill in the art will appreciate that the material for the capsule casing may be designed of various materials and may be selected based on certain desired solubility properties for a particular application. For example, the material for the capsule casing may be lube soluble and/or acid soluble. It also will be appreciated that the capsules may be retained on the crankcase filtration assembly by employing a variety of implementations, including for example, using binders and/or adhesives to dispose the capsules on the crankcase filtration assembly.

As an example of a releasing condition, the condensate material may exhibit an elevated acidic condition (i.e. pH lower than 7), or more commonly where the acidity is represented by total acid number, and where the condensate material has a higher total acid number (TAN) relative to new lubricating oil. When oil acidity is the releasing condition, an additive material that includes an alkaline chemical may be employed, where a reaction can occur with the basic compound (or pH buffer) to reduce and/or alleviate the acidic condition. After being treated by the additive material 20, the separated condensate material and larger drops of condensate material are returned to the engine's crankcase (i.e. reservoir 56 of engine 50) through the drain 18. That is, oil with a lower total acid number, or higher total base number (i.e. higher pH) would then be reintroduced to the engine as a diluent to the other engine oil. In some instances, any unreacted additive material that has been released by the release mechanism also may be allowed to flow into the engine and be introduced to the engine oil as a dosing agent, along with the treated condensate material.

One of skill in the art will appreciate that other conditions may be present in the condensate material which can function as the releasing condition(s). Likewise, the additive material employed to treat the oil may include various other active material(s), which may or may not include an alkaline chemical. For example, a releasing condition may be any condition in the condensate material that releases the function of any one or more of the additives discussed above and including Table 1. As above, one of skill in the art also will appreciate that the releasing condition may be the presence of the condensate material alone. That is, the release mechanism may be configured to release the additive material in the presence of the condensate material itself, for example oil, but where a condition detrimental to the operation life of the oil may not be present. For example, where the release mechanism is dissolvable capsules, the capsules may be formulated of a material that is lube soluble, and where a special condition (i.e. elevated acidity) need not be present in the oil.

In yet another embodiment, the release mechanism may be any solid composition containing the additive material therein and disposed on the crankcase filtration assembly. For example, the release mechanism may be a solid composition where the active additive material is held or embedded therein. In one embodiment, only the additive material may be dissolved from the composition when the releasing condition is present, and where the remaining composition does not dissolve. The solid composition may be formed as a coating material that may be disposed on any of the crankcase filtration assemblies described herein. In the example of a coating material for coating onto various surfaces of a crankcase filtration assembly, the additive material may be formulated with a base polymer that was injection molded into the copolymer of internal nonstructural surfaces (i.e. portions of the separator), so that it is part of the polymer structure and may diffuse out when it comes in contact with the condensate material. In yet another embodiment, it will be appreciated that the entire composition or coating material may dissolve into the condensate material if desired.

Figure 3:
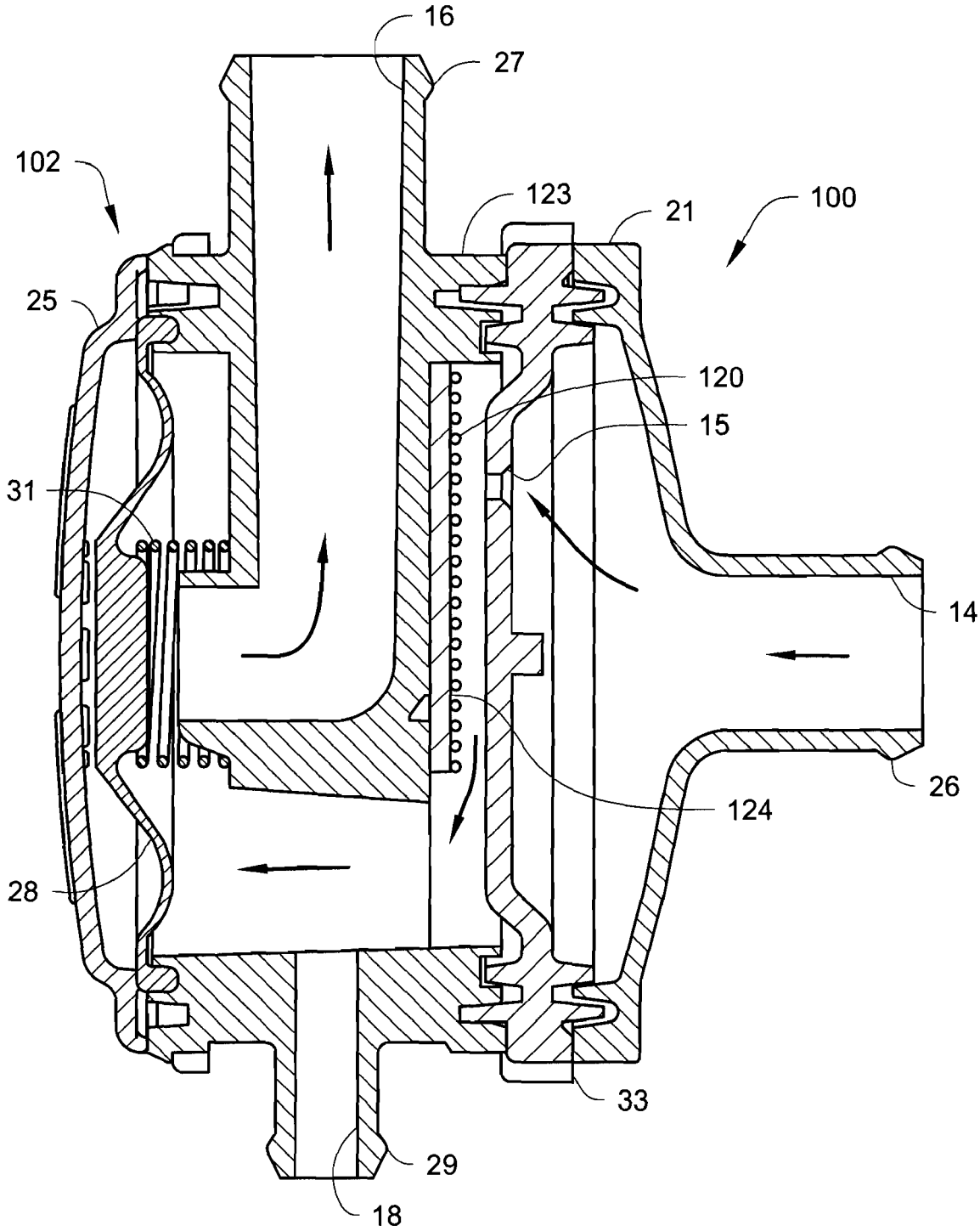
FIG. 3 shows a side sectional view of substantially the same crankcase filtration assembly as FIG. 1 and shows another embodiment of an additive material disposed on a separator of the crankcase filtration assembly.

Turning to FIG. 3, a side sectional view of another crankcase filtration assembly 100 is shown. The crankcase filtration assembly 100 is substantially the same as the crankcase filtration assembly 10 in FIG. 1. However, the crankcase filtration assembly 100 of FIG. 3 shows the additive material 120 disposed on the separator element 124 rather than directly on an inner surface of the housing 102 (i.e. collection reservoir 22). As shown, components 21, 123, 25, and seal plate 33 form the modified housing 120. Component 123 includes the outlet 16 and drain 18. Differently from crankcase filtration assembly 10, the housing 102 is configured where component 123 does not include the dedicated inner surface formed as a sump or collection reservoir proximate the drain 18. Other elements, components, and parts which are the same as crankcase filtration assembly 10 are not further described.

The additive material 120 may be disposed on the separator element 124 in a number of configurations. In one embodiment, the additive material 120 may be disposed on the outer surface of the separator element 124. In other embodiments, the additive material may be embedded within the separator element 124, such as when the separator element 124 is a media constructed with a fibrous material. In such a configuration, the additive material 20 may be spread throughout the fibrous material.

Where the additive material is to be released into the condensate material, the crankcase filtration assembly 100 may also include a release mechanism. In one embodiment, the release mechanism may be a plurality of capsules similar to the crankcase filtration assembly 10. Differently from crankcase filtration assembly 10, the plurality of capsules is disposed on the separator element 124 rather than on a collection reservoir proximate the drain. As with crankcase filtration assembly 10, the capsules contain the additive material 120 and may be constructed of a material to dissolve when a releasing condition is present in the condensate material, so that the additive material 120 is released when needed.

It will be appreciated that in other embodiments the release mechanism may be a solid composition applied as a coating material as described above and that holds or carries the additive material 120. The solid composition allows the additive material 120 to be dissolved, dissipated or released from the solid composition into the condensate material. In yet another embodiment, the release mechanism may be such that the separator 124 is soaked and dried with the additive material 120, where the dried additive material may be released once the condensate material is present. In such a configuration, the releasing condition is the presence of the condensate material alone.

Figure 5:
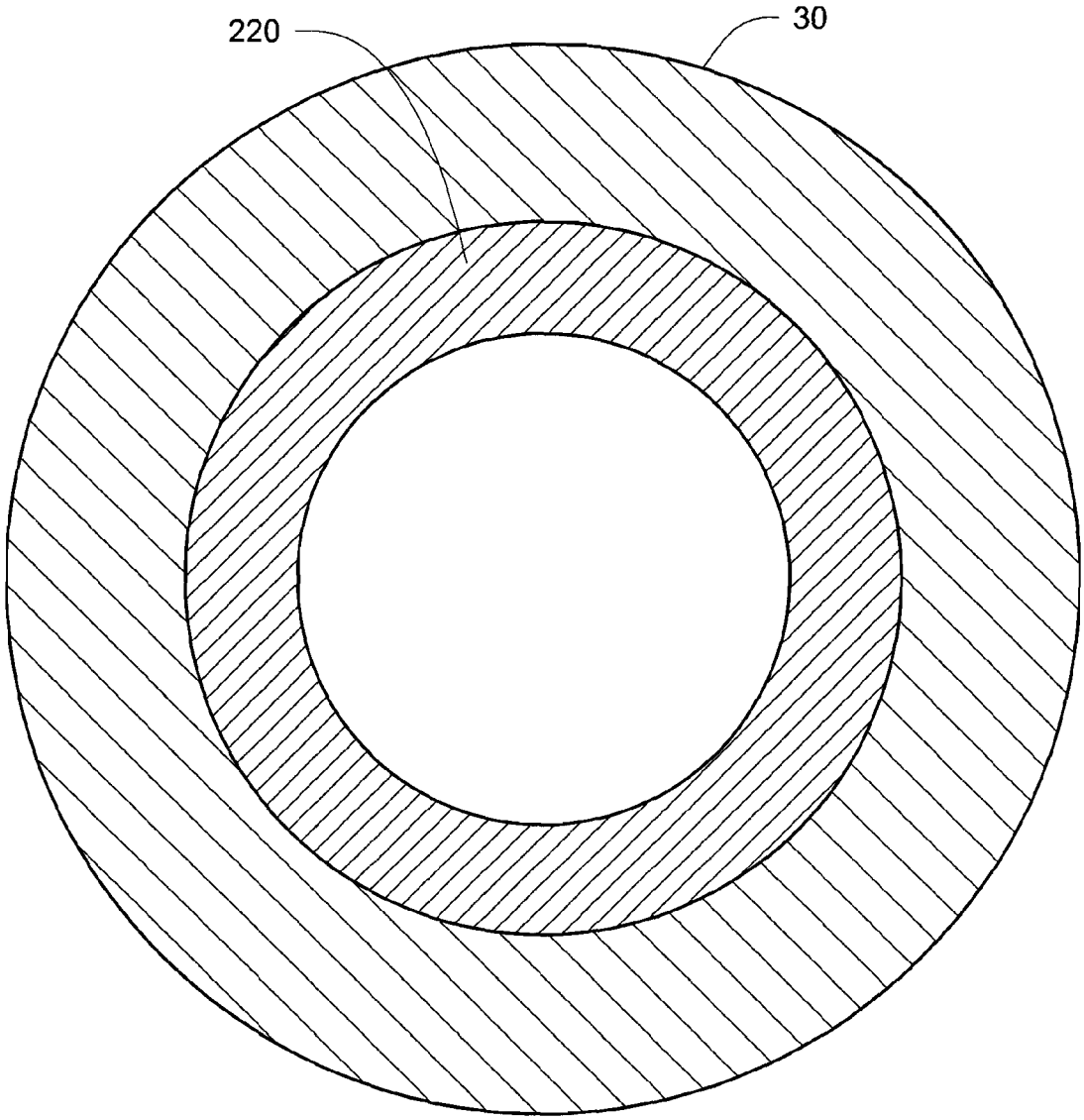
FIG. 5 shows a sectional view of a drain hose of the crankcase filtration assembly of FIG. 1 and shows the additive material disposed on an inside surface of the drain hose.

Turning to FIG. 5, another embodiment for disposing an additive material is shown. FIG. 5 shows a sectional view of the drain hose 30 of the crankcase filtration assembly 10 of FIG. 1, and shows the additive material 220 disposed on an inside surface of the drain hose 30. The additive material 220 is disposed on an inner diameter of the drain hose 30. As with the additive material 20 in FIG. 2, the additive material 220 may be contained in a release mechanism such as a plurality of capsules, which may be constructed of a material to dissolve when a releasing condition is present in the condensate material, so that the additive material 220 is released when needed. As shown, the release mechanism may be a solid composition, such as described above, that carries the additive material 220. The solid composition allows the additive material 220 to be dissolved, dissipated or released from the solid composition into the condensate material.

In another embodiment, the release mechanism may be configured as a coating material as described above. As yet another embodiment, the release mechanism may be such that at least the inner surface of the hose 30 is soaked and dried with the additive material 220, where the dried additive material may be released once the condensate material is present. In such a configuration, the releasing condition is the presence of the condensate material alone.

While FIG. 2 shows the additive material 20 on the inner surface 22 of the housing 12, and FIG. 3 shows the additive material 120 on the separator 124, and FIG. 5 shows the additive material 220 on the inner surface of the drain hose 30, it will be appreciated that a crankcase filtration assembly may include any one or more of these configurations on the same crankcase filtration assembly. That is, an additive material may be disposed on one or more of the housing, separator, and/or the drain hose. Generally, the additive material may be disposed on any one or more inner surface(s) of a crankcase filtration assembly, as long as the additive material may contact the condensate material to chemically treat it as desired and/or needed.

Figure 6:
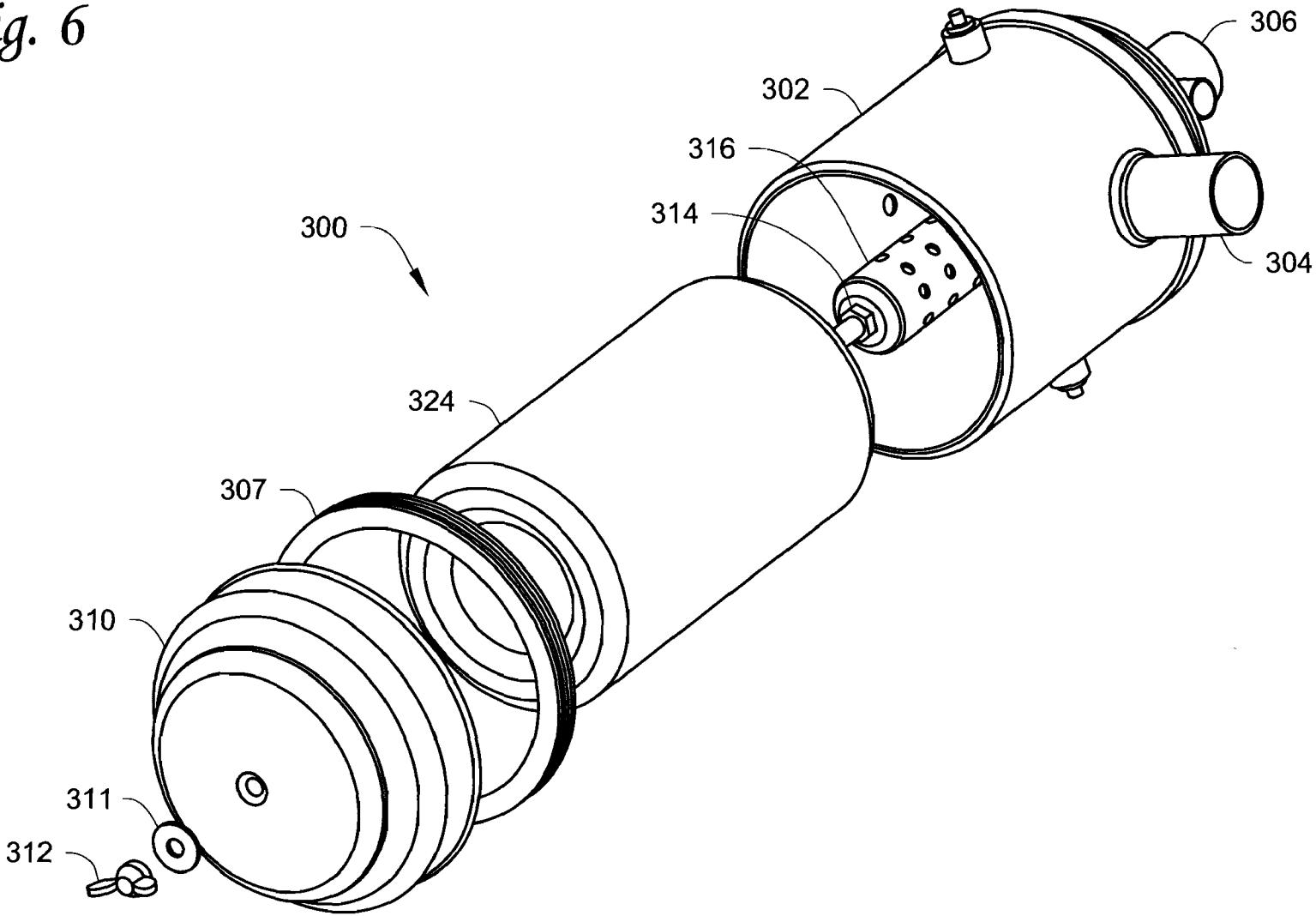
FIG. 6 is an exploded view of another embodiment of a crankcase filtration assembly.
Figure 7:
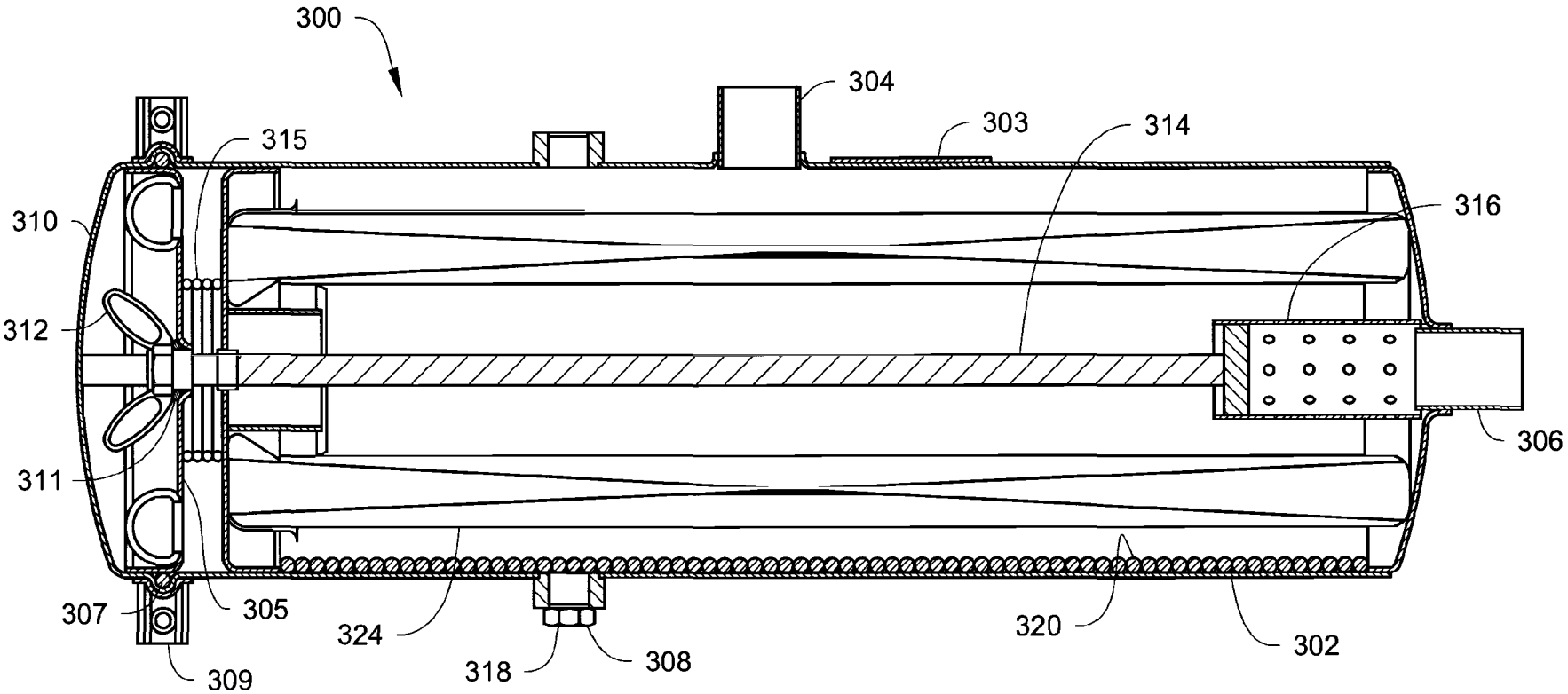
FIG. 7 shows a side sectional view of substantially the same crankcase filtration assembly of FIG. 6 and shows an embodiment of the additive material disposed on a housing of the crankcase filtration assembly.
Figure 8:
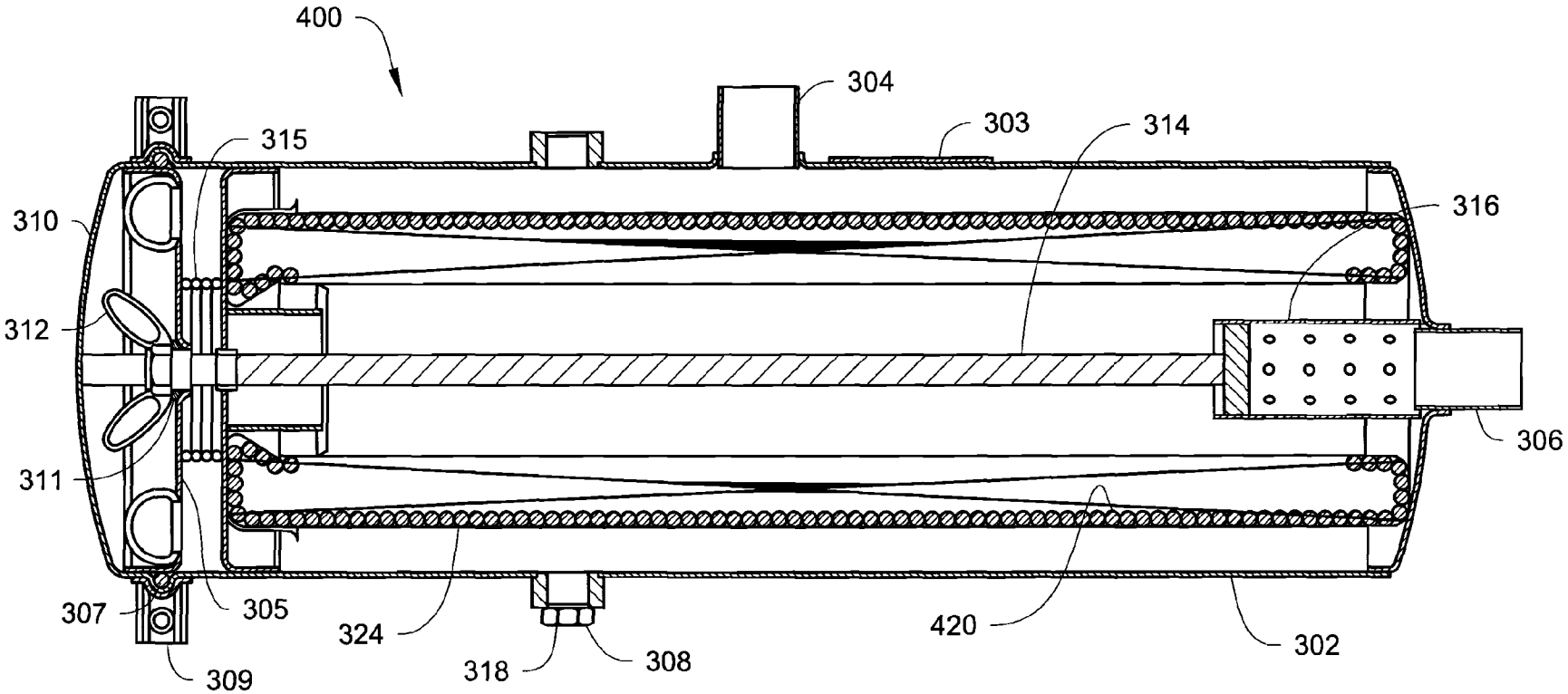
FIG. 8 shows a side sectional view of substantially the same crankcase filtration assembly as FIG. 6 and shows another embodiment of the additive material disposed on an outside surface of a filter element.

FIGS. 6-8 illustrate further embodiments of a crankcase filtration assembly. FIGS. 6-7 show one embodiment of crankcase filtration assembly 300 that includes a housing 302. The housing 302 includes an inlet 304. Similar to the previous crankcase filtration assemblies described, the inlet 304 is configured to be connected to an outlet of an engine and configured to receive blow-by fluids exiting the engine outlet. The housing 302 includes an outlet 306. The outlet 306 is configured to release gases of the blow-by fluids from the crankcase filtration assembly 300, which have been separated from the condensate material of the blow-by fluids. The outlet 306 also may be connected to a vent hose (not shown) connected to the outlet 306. The outlet 306 may release the gases to the surrounding environment (i.e. in open crankcase ventilation) or may allow the gases to return and be used by the engine (i.e. in closed crankcase ventilation). For example the gases may be delivered to an air intake or turbocharger system. One of skill in the art will appreciate that the inlet 304 and outlet 306 may include any suitable fitting as may be known in the art for respectively connecting the inlet 304 to an engine outlet and connecting the outlet 306 to a further connection or to an air intake system.

The housing 302 also includes a drain 308. The drain 308 is configured to release the condensate material from the crankcase filtration assembly 300, after the condensate material has been separated from the blow-by fluids. The condensate material may be released back to the engine, or may be collected in a reservoir for disposal. As with previous crankcase filtration assemblies described, the drain 308 in some embodiments may include a drain hose (i.e. drain hose 30) connected to the drain 308, where the drain hose is connected to an inlet of the engine, and where the returned condensate material may enter a reservoir and be reused in the engine. It will be appreciated that the drain 308 (or a drain hose if employed) may be connected to a check valve, where condensate material that may collect in the drain and/or drain hose is held by the check valve. When the pressure of the condensate material exceeds the pressure of the crankcase, the check valve may open so that condensate material may drain back to the crankcase.

As shown in FIGS. 6-7, the crankcase filtration assembly 300 includes a separator 324 disposed within the housing 302. The separator 324 is configured to separate the condensate material from the blow-by fluids entering the crankcase filtration assembly 300. The separator 324 allows gases of he blow-by fluids to be released through the outlet 306, as the condensate material is separated/removed from the blow-by fluids. The condensate material includes for example oil and/or water droplets, oil and/or water mist, and other non-gaseous material.

Differently from separators 24 and 124, the separator 324 is a flow through filter element. The filter element is in fluid communication with the inlet 304, outlet 306, and drain 308. As with the separators already described, when blow-by fluids enter the crankcase filtration assembly 300 through the inlet 304, the filter element may also provide a surface for separating the blow-by fluids, where some of the condensate material may fall out of or separate from the blow-by fluids.

As one example, the separator 324 is generally a cylindrically structured filter element. In one embodiment, the filter element is arranged and configured within the housing 302 such that the housing includes an outer chamber and an inner chamber. The outer chamber is between the inner sidewalls 303 of the housing and the outer wall of the separator 324. The inner chamber is defined by the perimeter of the inner sidewall of the separator 324. The outer chamber is in fluid communication with the inlet 304 and drain 308, and the inner chamber is in fluid communication with the outlet 306.

The separator 324 includes a certain media construction that is configured to allow flow through of the gases of the blow-by fluids into the inner chamber and out of the outlet 306. The media may be configured such that, when the blow-by fluids enter and come into contact with the filter element, coalescing of the condensate material takes place (i.e. oil and/or water mist or smaller/finer condensates) to be separated from gases of the blow-by fluids. It will be appreciated that the separator 324 may allow for some condensate material to pass through to the inner chamber. In such instances, the outlet 306 may also include a drain (see side opening at outlet 306) for releasing the condensate material that has passed through the filter element.

In one embodiment, the media is constructed to produce optimum results for coalescing of the condensate material. As with the media for a coalescer element, for example, the media for a filter element may be constructed of any fiber structure, and may be a gradient fiber structure. For instance, the gradient fiber structure may be configured as multiple layers, where the fineness of the fibers increases from the outer side to the inner side of the filter element. It will be appreciated that the media for the filter element may be arranged and configured using other implementations as may be known in the art, as long as separation of the condensate material may be accomplished. Other implementations may include, but are not limited to, wire mesh, screens, other filter types, or any other suitable coalescing structure. A suitable coalescing structure for a filter element is one that can momentarily trap and collect smaller droplets (oil mist) and condensates, so that larger drops may form (coalesce) and then fall out of the filter element toward the drain 308, but while allowing the gases of the blow-by fluids to flow through the outlet 306.

One of skill in the art will appreciate that the separator 324 is not limited to the particular structure or configuration shown, and will appreciate that various constructions and configurations may be employed for accomplishing the separator or filter element function.

As shown in FIGS. 6-7, the separator 324 is a filter element disposed within the housing 302. The filter element is connected or otherwise retained in the housing 302 and may be replaced after use. In one embodiment, a retainer assembly 305 may be employed to retain and connect the separator to the housing 302. For example, a band clamp 309 may connect a cover 310 to one end of the housing 302, and where a seal or gasket 307 provides a fluid tight seal for the connection. The filter element may be retained in place in the housing through connection of a post 314 to a washer 311 and wing nut 312, where a biasing member or spring 315 helps maintain an operating pressure when the crankcase filtration assembly 300 is in use. In one embodiment, the post 314 longitudinally extends through the inner chamber and inside the filter element, and extends through an endplate connected to the filter media. As shown, the post 314 is connected to a center tube 316. The center tube 316 includes apertures for allowing the blow-by gases (or generally clean gases) that enter the inner chamber to access the outlet 306 and be released from the crankcase filtration assembly 300. One of skill in the art will appreciate that the retainer structure for the filter element is not limited to the specific structure shown. It further will be appreciated that other suitable modifications may be made as long as the filter element may be retained within the housing, and as long as the flow of the blow-by fluids (i.e. condensate material and gases) through the crankcase filtration assembly may be accomplished.

The crankcase filtration assembly 300 further includes an additive material 320. Generally, FIG. 7 shows one embodiment of the crankcase filtration assembly 300 having the additive material 320 disposed on an inner surface 303 of the housing 302. As shown, the inner surface 303 is an inside wall surface of the housing 302. As with the crankcase filtration assembly 10, the additive material 320 in some examples is disposed proximate the drain 308. After oil droplets have been removed and the oil mist and other condensates have coalesced and have been removed from the blow-by fluids, they drip or fall toward the drain 308 at the inner surface 303. Differently from crankcase filtration assembly 10, the inner surface 303 is not a dedicated a sump component or collection reservoir, rather the inner surface 303 is the general inner sidewall of the housing 302. One of skill in the art will appreciate that the relative disposition of the additive material 320 on the inner surface 303 is not limited to the specific configuration shown. The additive material 320 may be disposed on various other inner surfaces inside the housing 302, as long as the condensate material may come into contact with the additive material 320. For example, the additive material 320 may be disposed on the inner wall surfaces of the inlet 304, drain 308, or any other inner surface of the housing 302 which may come into contact with condensate material that may flow through the crankcase filtration assembly 300.

As above, the term "additive material" is generally meant as a chemical material that can chemically treat the condensate material flowing through the crankcase filtration assembly and also may chemically treat the oil in the engine. Such chemical treatment generally may include providing an enhancing property to the engine oil, and/or an extending the operating life of the engine oil, and/or preventing conditions which may reduce the operating life of the oil. The additive material may be any composition and combination of materials as described above. The additive material may include any active material(s), binders, and/or adhesives, and may include such materials in any relative amounts and in any resulting particle sizes for certain formulations, as desired and/or necessary depending on the particular additive application.

As the condensate material (i.e. droplets, mist, and condensates) are removed from the blow-by fluids, the gases of the blow-by fluids may continue on and be ventilated from the crankcase filtration assembly 300 through the outlet 306, and the treated or "cleaned" oil and condensates may be drained from the crankcase filtration assembly 300.

Turning back to the additive material 320, the additive material 320 may be configured to be released into the separated condensate material when a releasing condition is present in the condensate material. As described above, the additive material also may be configured to remove condensate material that is detrimental to a fluid's operating life and retain such condensate material within the crankcase filtration assembly. In other embodiments, the additive material may be a plurality of additive chemicals that may be configured to perform both functions.

In the example where the additive material is releasable, the crankcase filtration assembly 300 may further include a release mechanism for releasing the additive material 320, so that it can react with the condensate material. As with the previous crankcase filtration assemblies described, the release mechanism may be configured and arranged in a number of ways. The release mechanism is configured to release the additive material 320 when a releasing condition is present. In some examples, the releasing condition is the presence of the condensate material alone, and/or is at least a certain condition exhibited by the condensate material. Such conditions that may be exhibited by the condensate material may include, but are not limited to, an acidic and/or a high viscosity condition. One of skill in the art will appreciate that the releasing condition(s) may include any condition which reduces, or is otherwise detrimental to the operation life of the engine oil. Likewise, one of skill in the art will recognize that a releasing condition would be that condition(s) for which an additive material is employed to have a particular desired effect.

As above, one embodiment of the release mechanism shows the additive material 320 contained in a plurality of capsules as in previous embodiments. FIG. 7 shows the capsules disposed on the inner surface 303 or sidewall of the housing 302. The capsule structure is the release mechanism for releasing the additive material 320 into the condensate material (i.e. oil droplets, mist, and/or condensate). For example, the capsules provide a casing structure for holding and carrying the additive material 320 therein, and provide a structure for releasing the additive material 320 when the condensate material permeates through the capsule casing, or otherwise dissolves the capsule casing.

The capsule casing is configured of a material that may be dissolvable, such as by a particular releasing condition present in the condensate material. In one embodiment, the capsules include a material formulated as a seal or skin as described above that can dissolve only when the releasing condition is present. In such a configuration, the release mechanism releases the additive material when the additive material is actually needed. For example, an elevated acidic condition present in the condensate material may be the releasing condition. When oil acidity is the releasing condition, an additive material that includes an alkaline chemical may be employed, where a reaction can occur with the basic compound (or pH buffer) to reduce and/or alleviate the acidic condition. After being chemically treated by the additive material 320, the coalesced condensate material and larger drops of condensate material are returned to the engine's crankcase (i.e. reservoir 56 of engine 50) through the drain 308. That is, oil with a lower total acid number, or higher total base number (i.e. lower pH) would then be reintroduced to the engine as a diluent to the other engine oil. Any unreacted additive material that has been released may be allowed to flow into the engine and be introduced to the engine oil as a dosing agent.

As discussed above, one of skill in the art will appreciate that other conditions present in the condensate material may function as the releasing condition(s), and the additive material employed to chemically treat the oil may include other active materials which may or may not include an alkaline chemical. As above, one of skill in the art also will appreciate that the releasing condition may be the presence of the condensate material alone. For example, the release mechanism may be configured to release the additive material in the presence of the oil itself and where a condition detrimental to the operating life of the oil may not be present. Where the release mechanism is dissolvable capsules, the capsules may be formulated of a material which may be dissolvable by the nature of the oil.

In another embodiment, the release mechanism may be any solid composition or coating material containing the additive material therein and disposed on the crankcase filtration assembly, such as described above. For example, the release mechanism may be a composition having the active additive material held or embedded therein. As one example, only the additive material may be dissolved from the overall solid composition when the releasing condition is present, and where the remaining portion of the composition does not dissolve into the condensate material. It will be appreciated that the entire composition or coating material may dissolve into the condensate material if desired.

Turning to FIG. 8, a side sectional view of another crankcase filtration assembly 400 is shown. The crankcase filtration assembly 400 is substantially the same as the crankcase filtration assembly 300 in FIGS. 6 and 7. However, the crankcase filtration assembly 400 shows the additive material 420 disposed on the filter element 324 rather than directly on an inner surface or sidewall of the housing 302. Other elements, components, and parts which are the same as crankcase filtration assembly 300 are not further described. The additive material 420 may be disposed on the filter element 324 in a number of configurations. As shown, the additive material 420 may be disposed on the outer surface of the filter element 324. In yet another embodiment, the additive material 420 may be embedded within the filter element 324, for example, when the filter element 324 includes a media constructed with a fibrous material and the additive material 420 is embedded within the fiber structure of the filter.

As described above, the additive material in certain embodiments is configured to be released into the separated condensate material when a releasing condition is present in the condensate material. In other embodiments, the additive material is configured to remove condensate material that is detrimental to a fluid's operating life and retain such condensate material within the crankcase filtration assembly. In other embodiments, the additive material may be a plurality of additive chemicals that may perform both functions.

In the example where the additive material is releasable, the crankcase filtration assembly 400 also includes a release mechanism. In one embodiment, similar to the crankcase filtration assembly 300, the crankcase filtration assembly 400 may include a plurality of capsules disposed on the filter element 324. As with crankcase filtration assembly 300, the capsules contain the additive material 420 and may be constructed of a material to dissolve when a releasing condition is present in the condensate material. In such a configuration, the additive material 420 may be released when needed and/or over a period of time. In another embodiment, it will be appreciated that the release mechanism may be a solid composition or coating material as described above, and disposed on the filter element where the additive material 420 is held or embedded therein. The solid composition may allow the additive material 420 to be dissolved, dissipated or released from the solid composition into the condensate material, but the remaining portion of the composition may not dissolve when the releasing condition is present. One of skill in the art will appreciate that that solid composition may be a porous matrix that also would allow the gases of the blow-by fluids to flow through the filter element to the outlet 306. It also will be appreciated that the entire composition or coating material may dissolve into the condensate material if desired.

In yet another embodiment, the release mechanism may be such that the filter element 324 is soaked and dried with the additive material 420, where the dried additive material may be released once the condensate material are present. In such an example, the releasing condition may be the presence of the condensate material alone.

As illustrated and described in the embodiments above, the additive material is disposed on a crankcase filtration assembly in a variety of configurations. The term "disposed on" is meant as being placed on, embedded within, or otherwise put within the crankcase filtration assembly in a certain location. For example, the additive material may be disposed on an inner surface of the crankcase filtration housing, whether on a dedicated collection reservoir or general sidewall. The additive material may be disposed on an inner surface of a drain hose leading back to an inlet of the engine. Likewise, the additive material may be disposed on or embedded with a separator element, including any one or more of a coalescing element, an impactor element, and/or a filter element as described herein. As shown, the additive material is disposed on one of the above locations for each crankcase filtration assembly. It will be appreciated, however, that any one or more of these implementations may be employed in a single crankcase filtration assembly if desired, where the additive material is disposed in multiple locations.

It will be appreciated that the technology also may be employed with virtually any crankcase ventilation filtration technology, not just the impactors, coalescers, and filters described herein. Such other crankcase ventilation technology includes, but is not limited to, depth filter elements, absorptive filter elements, wire mesh filters, centrifugal separators, labyrinth separators, and electrostatic droplet collection devices, so long as an additive material can be disposed within the filtration structure to contact and chemically treat condensate material flowing through.

While the inventive concepts described for a separator assembly are particularly well suited for engine crankcase ventilation applications, the inventive concepts have more general uses in other separation systems having immiscible fluids, e.g. air-oil, air-water, etc. More generally, the inventive concepts described herein are useful for systems that generally have a need to collect a condensate, chemically treat it, and return it to its source in a regenerated and/or improved form. For example, such separation systems may include but are not limited to boiler steam applications, food preparation applications, and hydraulic systems applications.

As described, the additive material in certain embodiments is configured to be released into the separated condensate material when a releasing condition is present in the condensate material. In other embodiments, the additive material is configured to remove condensate material that is detrimental to a fluid's operating life and retain such condensate material within the crankcase filtration assembly. That is, the additive material is not released into the condensate material, rather the additive material captures or removes certain condensate material (i.e. water) from the separated condensate materials so that they do not return to the engine or fluid source. In other embodiments, the additive material may be a plurality of additive chemicals that may perform both functions.

When the additive material is releasable, the term "released into" is meant to be non-limiting and may be any one or more additive materials being mixed, combined, dissolved, or dissipated into the condensate material, namely after the condensate material has been separated from the gases of the blow-by fluids. The particular interaction which the additive material may have with the condensate material is determined by the composition of the additive material, namely the active ingredient which is to have a desired effect on the condensate material.

In addition to the embodiments illustrated and described for the release mechanism, there are many other chemical release mechanisms which also may be employed. Generally, the release mechanism is one in which would allow the delivery of the additive material to the condensate material flowing through the crankcase filtration assembly. In the example of the release mechanism being a coating material containing the additive, the composition may be employed in other components of the crankcase filtration assembly. Such components may include but are not limited to a dissolving coating on centrifugal vanes, nozzles that can dissolve, and a puck of additive material placed directly in the flow stream of the blow-by fluids.

In other embodiments, the housing may include a separate vessel employed with various delivery technologies and adapted for use in any of the crankcase filtration assemblies shown. For instance, a vessel may be disposed proximate the drain or collection reservoir of the crankcase filtration assembly (see e.g. FIG. 2). In some examples, a vessel may be adapted for use in a crankcase filtration assembly that can hold the additive material and allow it to be released. In one example, the additive material may be formulated as liquid, where the vessel containing the additive material is configured for liquid diffusion.

Another vessel also may be employed and configured for diffusion from a fluid insoluble or soluble polymer matrix. For example, the additive material may be formed in a composition with a lube insoluble matrix. Similar to the solid composition described above, the additive material may diffuse or dissolve out of the lube insoluble matrix when the condensate material comes into contact with the additive material. The lube insoluble matrix could be designed to last for several filter service intervals. Either diffusion approach may include a lube soluble seal to cover and prolong mechanism life, thereby delaying use of the additive material until needed. That is, the lube soluble seal may be formulated to dissolve when the condensate material exhibits a certain characteristic (i.e. elevated acidity) and may further function as a part of the release mechanism.

Figure 9:
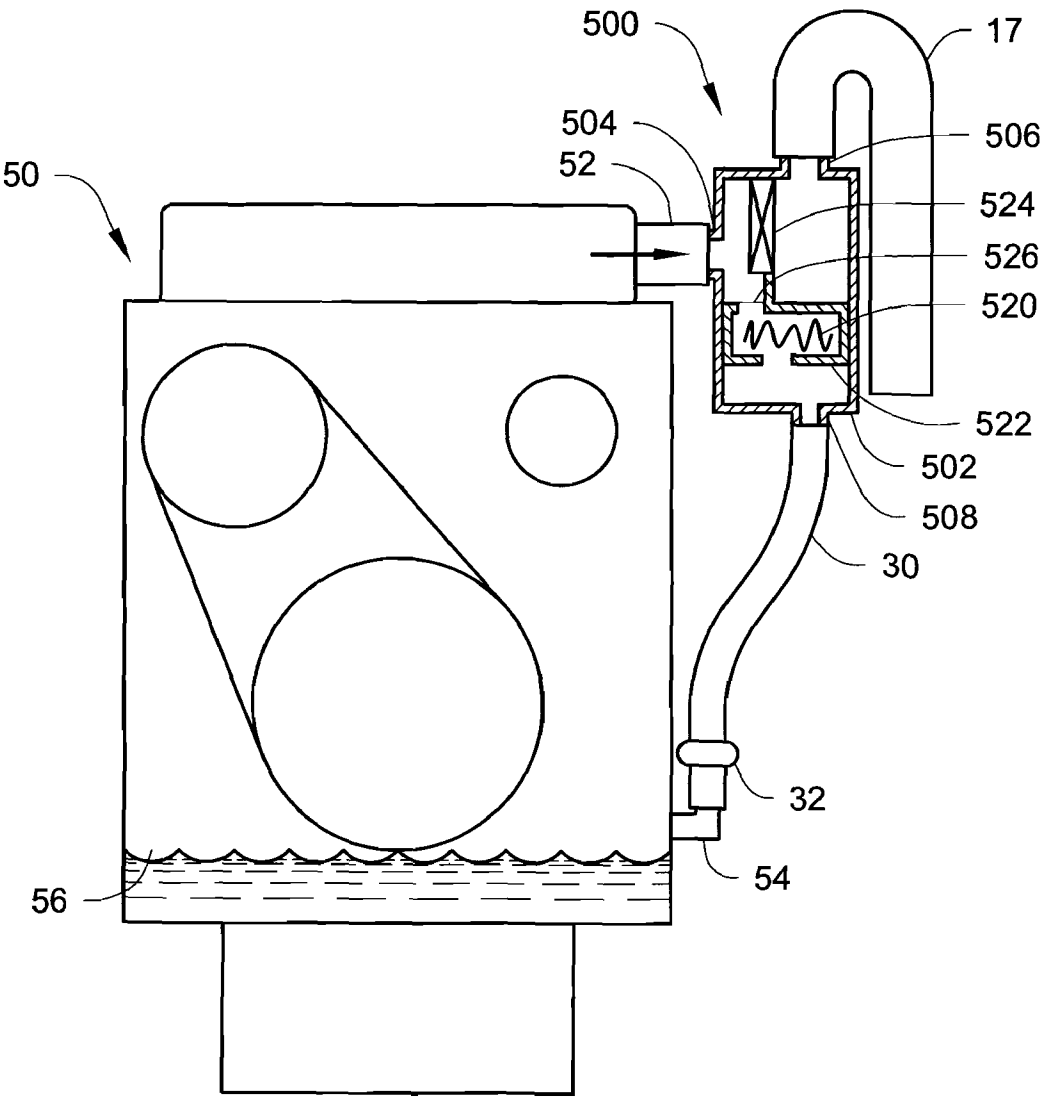
FIG. 9 shows a partial side sectional view of one embodiment of a release mechanism as a vessel containing an additive material.
Figure 10:
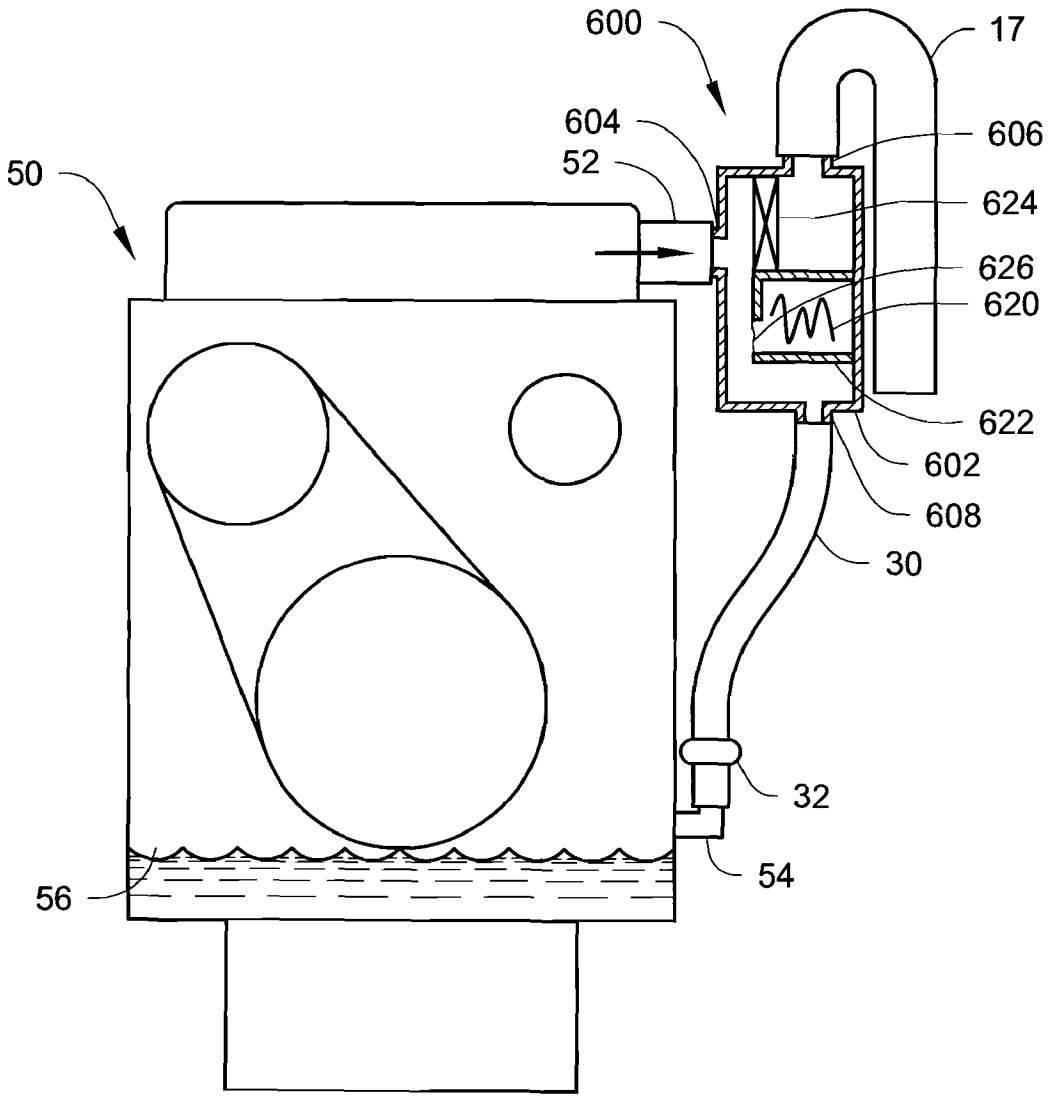
FIG. 10 shows a partial side sectional view of another embodiment of a release mechanism as a vessel containing an additive material.

FIGS. 9 and 10 show side sectional views of crankcase filtration assemblies 500 and 600 having a release mechanism with vessels as described above. FIGS. 9 and 10 generally show a schematic representation of how a vessel construction may be configured and arranged within a crankcase filtration assembly.

Turning to FIG. 9, the crankcase filtration assembly 500 includes a housing 502 connected to an engine 50 via an inlet 504 to an outlet 52 of a valve cover of the engine 50. As with previous crankcase filtration assemblies described, the inlet 504 is configured to receive blow-by fluids from the engine 50. The crankcase filtration assembly 500 also includes an outlet 506 for releasing gases of the blow-by fluids and a drain 508 for releasing condensate material that has been separated from the blow-by fluids and that has been chemically treated by an additive material 520. As shown, the drain 508 may be connected to a drain hose 30 and a check valve 32, so that condensate material may flow back to the engine via an inlet 54 and into a reservoir 56. Differently from the crankcase filtration assemblies described above, crankcase filtration assembly 500 includes a vessel 522 containing the additive material 520 therein. The vessel 522 may be employed and configured when the release mechanism is by diffusion from a fluid insoluble or soluble polymer matrix.

When the release mechanism is by an insoluble polymer matrix, the additive material 520 is contained in the insoluble polymer matrix and partially encased in the vessel 522 within the housing 502 of the crankcase filtration assembly 500. The vessel 522 separates the higher pressure from the lower pressure side. As shown, the vessel 522 is attached to the base of the separator 524 (i.e. impactor, coalescer, and/or filter element). The separator 524 allows gases from the blow-by fluids to continue to the outlet 506. The condensate material which has been impacted by the separator and/or has undergone coalescing falls toward the vessel 522. In one embodiment, the vessel 522 and the separator 524 are connected in a fluid tight seal. It will be appreciated that the vessel 522 may not be connected to the separator 524. Rather, an opening or flow path may exist between the separator 524 and vessel 522 so that the gases from the blow-by fluids also may flow through the flow path to the outlet 506.

The additive material 520 is released when the condensate material flows through the vessel 522 through a top opening. Such an approach may be ideal for additives that can extend lube life such as bases, dispersants or other wear inhibitors. In such a configuration, the additive material 520 is contained in the vessel and formed as a matrix containing the additive material 520, which is soluble, and a material that is fluid insoluble. The additive material may be released into the condensate material when the condensate material flows through the vessel. As one preferred embodiment, the vessel 522 and matrix are open at the top and bottom openings only, where the remainder of the vessel 522 is sealed with the housing 502. The top opening of the vessel 522 may be covered by a soluble coating 526. For example, the soluble coating 526 may be a polymer that can dissolve when a releasing condition is present in the condensate material, such as an elevated acidic condition.

In operation, as condensate material separates from the separator 524 and/or falls toward the vessel 522, the condensate material contacts the top opening of the vessel, dissolves or breaks through the soluble coating 526, diffuses through the matrix containing the additive material 520, and comes out the bottom opening thereby bringing dissolved additive material to the drain 508.

In yet another embodiment of the crankcase filtration assembly 500, a release mechanism may be where the vessel 522 contains the matrix material and the additive material 520, and where both the matrix material and the additive material are soluble. In such a configuration, the matrix material may be composed of a polymer material that is soluble. It will be appreciated that either diffusion approach may be employed, where release could be accomplished with a completely soluble matrix and soluble additive material, or where release could be accomplished with an insoluble matrix and a soluble additive material.

Turning to FIG. 10, the crankcase filtration assembly 600 includes a housing 602 connected to an engine 50 via an inlet 604 to an outlet 52 of a valve cover of the engine 50. As with previous crankcase filtration assemblies described, the inlet 604 is configured to receive blow-by fluids from the engine 50. The crankcase filtration assembly 600 also includes an outlet 606 for releasing gases of the blow-by fluids and a drain 608 for releasing condensate material that has been separated from the blow-by fluids and has been treated by an additive material 620. As shown, the drain 608 may be connected to a drain hose 30 and a check valve 32, so that condensate material may flow to the engine via an inlet 54 and into a reservoir 56. Differently from the crankcase filtration assemblies described above, crankcase filtration assembly 600 includes a vessel 622 containing the additive material 620 therein. The vessel 622 may be employed and configured when the release mechanism is configured for liquid diffusion.

When the release mechanism is by liquid diffusion, the additive material 620 may be formulated as liquid, where the vessel 622 contains the additive material 620 therein. As shown, the vessel 622 is attached to the base of the separator 624 (i.e. impactor, coalescer, and/or filter element). The separator 624 is configured to allow gases from the blow-by fluids to continue to the outlet 606. The condensate material that has been separated by the separator and/or has undergone coalescing falls toward the vessel 622. In one embodiment, the vessel 622 and the separator 624 are connected in a fluid tight seal. It will be appreciated that the vessel 622 may not be connected to the separator 624. Rather, an opening or flow path may exist between the separator 624 and vessel 622 so that the gases from the blow-by fluids also may flow through the flow path to the outlet 606.

The additive material 620 is released when the condensate material flows to the vessel 622, and a soluble coating 626 is dissolved or broken. Once the soluble coating 626 has been dissolved or at least broken, the additive material 620 may diffuse out of the vessel 622 and into the condensate material. In one example, the soluble coating 626 may be a polymer that can dissolve when any releasing condition(s) is present in the condensate material, for instance, when the condensate material exhibits an elevated acidic condition.

In operation, as condensate material separated from the separator 624 and falls toward the vessel 622, the condensate material contacts the soluble coating 626 of the vessel 622. If the condensate material exhibits a certain releasing condition to dissolve or at least break the soluble coating, then the additive material 620 diffuses out of the vessel 622. The additive material 620 having been released into the condensate material thereby is allowed to be released from the crankcase filtration assembly 600 through the drain 608. Thus, the treated condensate material and any unreacted additive material may be returned back to the engine 50.

Depending on the release mechanism, the release rate may be tailored for optimal delivery. One of skill in the art would recognize that optimal delivery may be a function of, for instance, the unexpected condensate capture rate, solubility of the chemical used to treat the condensate, total vessel/sump volume, and the rate of acid build up in the oil or the rate of additive decline in the oil.

As described herein, the separator assemblies described may be used in crankcase ventilation applications for engine oil filtration. In particular, the crankcase filtration assemblies described can provide a unique structure having a component treated with an additive material, which may reduce an acidic condition in condensate material received by the crankcase filtration assembly, and more generally may chemically treat the condensate material to enhance and/or extend engine oil life. The crankcase filtration assembly described herein may be employed in any type of crankcase ventilation system for engine oil filtration, including for example use in natural gas engines employed at NG well heads, in landfills, is sour gas applications, and including use in diesel engines and industrial engines, including stationary or vehicular engines.

While the inventive concepts described for a separator assembly are particularly well suited for engine crankcase ventilation applications, the inventive concepts have more general uses in other separation systems having immiscible fluids, e.g. air-oil, fuel-water, water-oil, etc. More generally, the inventive concepts described herein are useful for systems that generally have a need to collect a condensate, chemically treat it, and return it to its source in a regenerated and/or improved form. For example, such separation systems may include but are not limited to boiler steam applications, food preparation applications, and hydraulic systems applications.

Of course, it will be appreciated that any of the inventive concepts described herein may be generally applicable to other separator assemblies and methods of treating a condensate material, for instance, in various fluid materials having both gas and condensates in a fluid stream and which may not be directed to crankcase ventilation filtration. Such other applications may employ the same or similar additive materials as suitable and/or desired depending on the particular separation implementation needed.

In such other embodiments, a separation assembly for separation of a fluid may include a housing having an inlet configured to receive a fluid material. A separator is disposed within the housing, and the separator is configured to separate condensate material from the fluid material. The housing includes an outlet configured to release remaining gases of the fluid material from the housing, as the condensate material is separated from fluid material. The housing also has a drain configured to release the condensate material. A suitable additive material is disposed within the separator assembly, where the additive material is configured to chemically treat the condensate material when a condition is present in the condensate material.

A method of treating condensate material employing such a general separation assembly includes receiving fluid material into the separator assembly, and separating condensate material from the fluid material. The condensate material is chemically treated with an additive material when a condition is present in the condensate material. Remaining gases of the fluid material are released from the separator assembly, as the condensate material is separated from the fluid material. The condensate material is released from the separator assembly and separately from the releasing of the remaining gases of the fluid material.

The inventive concepts disclosed herein may be embodied in other forms without departing from the spirit or novel characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. A crankcase filtration assembly for engine oil filtration comprising:

a housing having an inlet configured to receive blow-by fluids ventilated by an engine;

a separator disposed within the housing, the separator configured to separate condensate material from the blow-by fluids;

the housing having an outlet configured to release remaining gases of the blow-by fluids from the housing, as the condensate material is separated from the blow-by fluids, the housing having a drain configured to release the condensate material;

an additive material disposed within the crankcase filtration assembly, the additive material configured to chemically treat the condensate material when a condition is present in the condensate material; and a release mechanism disposed on the crankcase filtration assembly, the release mechanism configured to release the additive material when a releasing condition is present.

2. The crankcase filtration assembly of claim 1, wherein the separator comprises at least one of a filter element and an impactor element, that when the separator is contacted by the blow-by fluids, the separator is configured to separate the condensate material from the blow-by fluids allowing the remaining gases to continue through the outlet of the housing, and allowing the condensate material to continue through the drain of the housing.

3. The crankcase filtration assembly of claim 2, wherein the filter element comprises a structure arranged and configured within the housing such that the housing includes an outer chamber in communication with the inlet and drain and an inner chamber in communication with the outlet, the filter element is constructed of a media that is configured to allow flow through of the remaining gases of the blow-by fluids into the inner chamber and out of the outlet.

4. The crankcase filtration assembly of claim 2, wherein the separator is configured to coalesce the condensate material.

5. The crankcase filtration assembly of claim 1, wherein the condensate material includes at least one of liquid oil, water, and other non-gaseous material.

6. The crankcase filtration assembly of claim 1, wherein the additive material is disposed on at least one of an inner surface of the housing and a surface of the separator.

7. The crankcase filtration assembly of claim 1, wherein the drain further comprising a drain hose connected to the drain, the drain hose configured to return the condensate material released by the drain to the engine, the additive material being disposed on an inner surface of the drain hose.

8. The crankcase filtration assembly of claim 1, the housing further comprising a sump component, the sump component proximate the drain, the additive material being disposed on a surface of the sump component.

9. The crankcase filtration assembly of claim 1, wherein the additive material comprises an alkaline chemical additive.

10. The crankcase filtration assembly of claim 1, wherein the additive material is configured to remove a portion of the condensate material from the blow-by fluids and retain such condensate material within the crankcase filtration assembly.

11. The crankcase filtration assembly of claim 1, wherein the release mechanism is configured to release the additive material over a period of time.

12. The crankcase filtration assembly of claim 1, wherein the release mechanism comprising a plurality of capsules containing the additive material therein, the capsules including a material being dissolvable to release the additive material when the releasing condition is present.

13. The crankcase filtration assembly of claim 1, wherein the release mechanism comprising a coating material, the coating material including a solid composition having the additive material embedded therein, at least the additive material being dissolvable from the solid composition to release the additive material when the releasing condition is present.

14. The crankcase filtration assembly of claim 1, wherein the release mechanism comprising a vessel that contains the additive material and releases the additive material when the releasing condition is present.

15. The crankcase filtration assembly of claim 1, wherein the releasing condition including at least one of contact between the additive material and the condensate material, an acidic condition existing in the condensate material, and a condition present in the condensate material which reduces engine oil life.

16. A method of crankcase ventilation in engine oil filtration comprising:

receiving blow-by fluids ventilated by an engine into a crankcase filtration assembly;

separating condensate material from the blow-by fluids;

chemically treating the condensate material with an additive material when a condition is present in the condensate material, the step of chemically treating including releasing the additive material with a release mechanism disposed on the crankcase filtration assembly, the release mechanism configured to release the additive material when a releasing condition is present;

releasing remaining gases of the blow-by fluids from the crankcase filtration assembly, as the condensate material is separated from the blow-by fluids, and releasing the condensate material from the crankcase filtration assembly and separately from the releasing of the remaining gases of the blow-by fluids.

17. The method of claim 16, wherein the step of releasing the additive material comprises releasing an alkaline material when the condensate material exhibits an acidic condition.

18. A separation assembly for separation and treatment of a condensate material comprising:

a housing having an inlet configured to receive a fluid material;

a separator disposed within the housing, the separator configured to separate condensate material from the fluid material;

the housing having an outlet configured to release remaining gases of the fluid material from the housing, as the condensate material is separated from fluid material, the housing having a drain configured to release the condensate material;

an additive material disposed within the separation assembly, the additive material configured to chemically treat the condensate material when a condition is present in the condensate material, and a release mechanism disposed on the separation assembly, the release mechanism configured to release the additive material when a releasing condition is present.

19. A method of treating a condensate material present in a fluid material comprising:

receiving fluid material into a separator assembly;

separating condensate material from the fluid material;

chemically treating the condensate material with an additive material when a condition is present in the condensate material, the step of chemically treating including releasing the additive material with a release mechanism disposed on the separator assembly, the release mechanism configured to release the additive material when a releasing condition is present;

releasing remaining gases of the fluid material from the separator assembly, as the condensate material is separated from the fluid material, and releasing the condensate material from the separator assembly and separately from the releasing of the remaining gases of the fluid material.

* * * * *